US007294969B2

(12) United States Patent
Kuninaka

(10) Patent No.: US 7,294,969 B2
(45) Date of Patent: Nov. 13, 2007

(54) TWO-STAGE HALL EFFECT PLASMA ACCELERATOR INCLUDING PLASMA SOURCE DRIVEN BY HIGH-FREQUENCY DISCHARGE

(75) Inventor: Hitoshi Kuninaka, Sagamihara (JP)

(73) Assignee: Japan Aerospace Exploration Agency, Tokyo (JP)

( * ) Notice: Subject to any disclaimer, the term of this patent is extended or adjusted under 35 U.S.C. 154(b) by 330 days.

(21) Appl. No.: 11/141,189

(22) Filed: Jun. 1, 2005

(65) Prior Publication Data

US 2006/0290287 A1 Dec. 28, 2006

(30) Foreign Application Priority Data

Nov. 24, 2004 (JP) ..... 2004-338676

(51) Int. Cl.
*H01J 1/52* (2006.01)

(52) U.S. Cl. ..... 315/111.21; 315/111.61; 313/359.1; 313/361.1

(58) Field of Classification Search ..... 315/111.21, 315/111.31, 111.41, 111.61; 313/359.1, 361.1, 313/362.1

See application file for complete search history.

(56) References Cited

U.S. PATENT DOCUMENTS 5,475,354 A 12/1995 Valentian et al.
5,581,155 A 12/1996 Morozov et al.
5,847,493 A * 12/1998 Yashnov et al. ..... 313/231.31
5,945,781 A * 8/1999 Valentian ..... 315/111.81
6,281,622 B1 8/2001 Valentian et al.

(Continued)

FOREIGN PATENT DOCUMENTS

JP 04229996 8/1992

(Continued)

OTHER PUBLICATIONS

Morozov et al., "Research of the Magnetic Field on a Closed-Electron-Drift Accelerator", Soviet Physics Technical Physics, vol. 17, No. 3, 1972, pp. 482-487.

(Continued)

*Primary Examiner*—David H. Vu
(74) *Attorney, Agent, or Firm*—Jacobson Holman PLLC

(57) ABSTRACT

Disclosed is a high-frequency discharge plasma generation-based two-stage Hall-effect plasma accelerator, which comprises an annular acceleration channel having a gas inlet port, a high-frequency wave supply section, an anode, a cathode, a neutralizing electron generation portion and a magnetic-field generation element, wherein: gas introduced from the gas inlet port into the annular acceleration channel is ionized by a high-frequency wave supplied from the high-frequency wave supply section, to generate plasma; a positive ion includes in the generated plasma is accelerated by an acceleration voltage applied between the anode and cathode, and ejected outside; and an electron included in the generated plasma is restricted in its movement in the axial direction of the annular acceleration channel by an interaction with a magnetic field. The two-stage Hall-effect plasma accelerator is designed to control a degree of ion acceleration in accordance with the acceleration voltage serving as an acceleration control parameter, and control an amount of plasma generation in accordance with the high-frequency wave output serving as a plasma-generation control parameter. The two-stage Hall-effect plasma accelerator of the present invention can control the ion acceleration and the plasma generation in a highly independent manner.

12 Claims, 12 Drawing Sheets

U.S. PATENT DOCUMENTS 6,750,600 B2 * 6/2004 Kaufman et al. ..... 313/361.1

FOREIGN PATENT DOCUMENTS

| | | |
|---|---|---|
| JP | 05240143 | 9/1993 |
| JP | 08500699 | 1/1996 |
| JP | 08500930 | 1/1996 |
| JP | 2895472 B1 | 3/1999 |
| JP | 11297497 | 5/1999 |
| JP | 11505058 | 5/1999 |
| JP | 2000073937 | 3/2000 |
| JP | 2001521597 | 11/2001 |
| JP | 2002504968 | 2/2002 |
| JP | 2002516644 | 6/2002 |
| JP | 2002517661 | 6/2002 |

OTHER PUBLICATIONS

Morozov et al., "Plasma Acceleration with Closed Electron Drift and Extended Acceleration Zone", Soviet Physics Technical Physics, vol. 17, No. 1, 1972, pp. 38-45.

Gavryushin et al., "Effect of the Characteristics of a Magnetic Field on the parameters of an Ion Current at the Output of an Acceleration with Closed Electron Drift", Soviet Physics Technical Physics, vol. 26, No. 4, 1981, pp. 505-507.

Bishaev et al., "Local Plasma Properties in a Hall-Current Accelerator with an Extended Acceleration Zone", Soviet Physics Technical Physics, vol. 23, No. 9, 1978, pp. 1055-1057.

Yamagiwa et al., "Performance of Double-Stage- Discharge Hall Ion Thruster", Journal of Propulsion and Power, vol. 7, No. 1, 1991, pp. 65-70.

Morozov et al., "Research on Two-Stage Engine SPT-MAG", IEPC03-290, International Electric Propulsion Conference, 2003, France.

* cited by examiner

TWO-STAGE HALL EFFECT PLASMA ACCELERATOR INCLUDING PLASMA SOURCE DRIVEN BY HIGH-FREQUENCY DISCHARGE

BACKGROUND OF THE INVENTION

1. Technical Field

The present invention relates to a plasma accelerator, and more particularly to a two-stage Hall-effect plasma accelerator, and various apparatuses using the same, such as a space propulsion engine, an ion acceleration apparatus and a plasma etching apparatus.

2. Description of the Background Art

As one type of electric propulsion rockets adapted to be used as a space propulsion engine, there has been known a Hall-effect accelerator developed mainly in the former Soviet Union. The Hall-effect plasma accelerator comprises an annular acceleration channel and a mechanism for applying a magnetic field and an electric field, respectively, in the radial and axial directions of the annular acceleration channel. A cathode for emitting electrons is disposed in the vicinity of the downstream end (outlet or open end) of the annular acceleration channel, and an anode is disposed at the upstream end (opposite end of the outlet) of the annular acceleration channel. The cathode is operable to emit into external space an electron current equal to an ion current to be accelerated and ejected from the annular acceleration channel. The emitted electrons flow upstream toward the anode to play a role in reducing a space charge limiting effect in an acceleration section so as to assist ion acceleration, and ionizing a propellant.

An acceleration mechanism of the Hall-effect plasma accelerator can be explained by two types of operation mechanisms: electrostatic acceleration and electromagnetic acceleration (see, for example, the following Non-Patent Publication 1). The former is based on a particle acceleration model, and the latter is based on the concept of plasma fluid. Specifically, according to the electromagnetic acceleration model, a Hall current is induced in the circumferential direction of an annular-shaped plasma acceleration section by a radially-applied external magnetic field and an axially-applied electric field, and electromagnetic acceleration caused by the interference between the Hall current and the external magnetic field forms the basis of the acceleration mechanism of the Hall-effect plasma accelerator. According to the electrostatic acceleration model, a radially-applied magnetic field acts to restrain the axial movement of electrons so as to allow an axially-applied electric field to be maintained at a high intensity, electrostatic acceleration, or electrostatic acceleration of propellant ions, caused by the electric field forms the basis of the acceleration mechanism of the Hall-effect plasma accelerator. The Hall-effect plasma accelerator is also called a closed electron drift thruster.

FIG. 1 is a partially cutaway perspective sectional view showing the structure of a conventional Hall-effect plasma accelerator 100. The Hall-effect plasma accelerator comprises a pole piece 101, an acceleration channel 102, a coil 103*a*, a coil 103*b*, a coil 104, a propellant feed port 105*a*, a propellant discharge port 105*b*, an anode 106, a cathode 107, a wiring 108, an acceleration power source 109 and a neutralizer power source 110.

The pole piece 101 is adapted to guide magnetic field lines generated by the coils 103*a*, 103*b*, 104 in such a manner that a magnetic field is distributed over the acceleration channel 102 at a given intensity with a suitable configuration for generation of plasma and acceleration of ions. Specifically, a relatively strong magnetic field is distributed in the vicinity of an outlet downstream end; upper side of FIG. 1) of the acceleration channel 102 to accelerate ions, and a relatively weak magnetic field is distributed around the opposite end (upstream end; lower side of FIG. 1) of the outlet. The anode 106 is placed at the upstream end of the acceleration channel 102, and adapted to cooperate with the cathode 107 disposed in the vicinity of the downstream outlet to generate an electric field therebetween, and accelerate ions residing in the acceleration channel 102 by the electric field. The coils 103*a*, 103*b*, 104 are adapted to receive an electric power from an appropriate power source (not shown) to generate a magnetic field. The propellant feed port 105*a* is an inlet for introducing a propellant, such as xenon gas, inside the Hall-effect plasma accelerator 100. The introduced propellant will be discharged from the propellant discharge port 105*b* into the acceleration channel 102. The acceleration power source 109 is adapted to generate a given voltage and apply the voltage between the anode 106 and the cathode 107 through the wiring 108. In this case, a positive voltage relative to the cathode 107 is applied to the anode 106. This voltage acts for both the generation of plasma and the acceleration of propellant ions, as will be described in detail later. Based on an electric field generated by this voltage, the plasma generation and the propellant-ion acceleration will be primarily performed, respectively, in the upstream and downstream regions of the acceleration channel 102.

The cathode 107 also serves as a hot cathode or neutralizer for emitting electrons to neutralize the charge of ejected propellant ions. The neutralizer power source 110 is adapted to supply to the cathode 107 an electric power for heating the hot cathode.

A plasma generation mechanism and an ion acceleration mechanism in the conventional Hall-effect plasma accelerator 100 will be described below. Firstly, these mechanisms will be explained based on the electrostatic acceleration model. FIG. 2 is a conceptual explanatory diagram of the electrostatic acceleration model-based acceleration mechanism of the conventional Hall-effect plasma accelerator 100. In FIG. 2, the acceleration channel 102 is illustrated in a partially cutaway perspective sectional view, and each of a magnetic field B, an electric field E, a propellant neutral particle (indicated by "n"), an electron (indicated by "e") and a propellant ion (indicated by "p") is illustrated in a model format.

The ion acceleration mechanism based on the electrostatic acceleration model is as follows. Within the acceleration channel 102, an electric field E is formed that is a DC electric field generated by a voltage applied axially from the upstream end to the downstream end. A magnetic field B is formed in the radial direction of the acceleration channel 102 in such a manner that the intensity of the magnetic field B is set at a low value in the upstream region of the acceleration channel 102, and increased toward the downstream end of the acceleration channel 102. When an electron is placed in the magnetic field B, the electron receives a Lorentz force generated in a direction orthogonal to the magnetic field B by an interaction between the magnetic field B and the charge/velocity of the electron, and thereby undergoes a Larmor motion which is a rotational motion around the magnetic line of the magnetic field B, so that an axial movement of the electron is restricted. In contract, while a propellant ion also receives a Lorentz force generated in a direction orthogonal to the magnetic field B when it is placed in the magnetic field B, the ion is moved in a Larmor radius far greater than that of the electron, because the ion has a mass per charge, which is far greater than that of the electron. Thus, it can be designed such that the electron is rotated around the magnetic line in such a manner as to be restrained by the magnetic field B, whereas the propellant ion has an approximately linear motion without restraint by the magnetic field B.

A mechanism for generating plasma will also be mentioned below. In the upstream region where the magnetic field B has a relatively low intensity, an electron is not so strongly restrained by the magnetic field, as compared to the downstream region. Thus, the electron is apt to be accelerated toward the anode 106. This greatly-accelerated electron will collide with a propellant neutral particle to ionize the propellant neutral particle or dissociate the propellant neutral particle into an electron and a propellant ion. In this way, plasma is generated.

The acceleration mechanism will be more specifically described. A part of electrons emitted from the cathode disposed in the vicinity of the downstream end of the acceleration channel 102 are drawn by the anode 106 to thereby enter into the acceleration channel 102. The electrons entered in the acceleration channel 102 act to reduce a space charge limiting effect in an acceleration section so as to assist the acceleration of propellant ions, and to ionize a propellant gas after further moving to a plasma generation section, as will be described in detail later. The electrons entered in the acceleration channel 102 are constrained by the magnetic field B to undergo a Larmor motion, and thereby not absorbed by the anode 106 immediately. The reference code E23 in FIG. 2 indicates one electron restrained by the magnetic field B due to a Larmor motion induced therein. The electron E23 is gradually drawn by the anode 106 to move to the upstream end of the acceleration channel 102. During this process, the electron E23 is accelerated by the electric field E to acquire a large kinetic energy. The reference code E21 indicates one electron accelerated to high speed in this manner. In the upstream region of the acceleration channel 102 where the magnetic field B is set at a low intensity, and the electrons are accelerated to high speed, the electrons have a larger Larmor radius. The electron E21 having a large kinetic energy collides with a propellant neutral particle N22 to dissociate the propellant neutral particle N22 into an electron E22 and a propellant ion P22. In this way, a number of propellant neutral particles are ionized by the high-speed electrons to generate plasma. That is, the upstream region of the acceleration channel 102 serves as a plasma generation section. The generated propellant ion P22 has a large enough mass to avoid the restraint on its axial movement due to a Larmor motion to be induced by the magnetic field B. Thus, the propellant ion P22 is accelerated toward the downstream end by the electric field E, and ejected from the open end of the acceleration channel 102 as a high-speed propellant ion P24 to produce a thrust equal to a reaction force against the ejection. That is, the downstream region of the acceleration channel 102 serves as an acceleration section. The arrow shown above the propellant ion P22 means that the propellant ion P22 is accelerated toward the downstream end without restraint by the magnetic field B. In the downstream region of the acceleration channel 102, the electron E23 is strongly restrained by the high-intensity magnetic field B. Thus, a numbers of electrons can be located in the acceleration section of the acceleration channel 102 together with positively-charged propellant ions. That is, the acceleration section of the acceleration channel 102 can be kept in an electrically quasi-neutral plasma state. This makes it possible to apply a large voltage between the cathode 107 and the anode 106 so as to supply a large current therebetween without restrictions from the law for space-charge limited current, whereby a larger number of propellant ions can be accelerated and ejected to obtain higher thrust. An electron E24 as a part of electrons emitted from the cathode 107 is moved in the downstream direction of the acceleration channel 102 to neutralize the propellant ion P24. Thus, the electron E24 produces an electron current flow having an intensity equal to that of an ion current produced by the propellant ion P24. All of the electrons in the acceleration channel 102 will be finally absorbed by the anode 106.

Secondly, the plasma generation and ion acceleration mechanisms will be explained based on the electromagnetic acceleration model. FIG. 3 is a conceptual explanatory diagram of the electromagnetic acceleration model-based acceleration mechanism of the conventional Hall-effect plasma accelerator 100. In FIG. 3, the acceleration channel 102 is illustrated in a partially cutaway perspective sectional view, and each of a magnetic field B, an electric field E, a current J, a Lorentz force F, an electron (indicated by "e") and a propellant ion (indicated by "p") is illustrated in a model format.

The ion acceleration mechanism based on the electromagnet acceleration model is as follows. A magnetic field B is formed in the radial direction of the acceleration channel 102. When an electron is placed in the magnetic field B, the electron receives a Lorentz force generated by the interaction between the magnetic field B and the charge/velocity of the electron, and thereby undergoes a Larmor motion which is a rotational motion around the magnetic line of the magnetic field B, so that an axial movement of the electron is restricted. Within the acceleration channel 102, an electric field E is also formed that is a DC electric field generated by a voltage applied axially from the upstream end to the downstream end. During the Larmor motion around the magnetic line, the electron is accelerated and decelerated by the electric field, and thereby an E×B drift is induced where the coordinate of the center of the circular orbit is shifted in one circumferential direction of the acceleration channel 102. Thus, a current flow is generated in the opposite direction of the drift direction. While a force inducing an E×B drift in the same direction as that in the electron to generate a current flow in the same direction as the drift direction simultaneously acts on a propellant ion, the propellant ion having a larger Larmor radius will be moved toward the downstream end without steady circumferential shifting, and ejected from the acceleration channel 102. Thus, the circumferential current is induced only by the electron, and thereby a unidirectional current flows in the circumferential direction. This current is referred to as "Hall current". This circumferential current flows in a direction orthogonal to the magnetic current B to produce a Lorentz force which acts on a plasma fluid consisting of electrons and propellant ions with the circumferential current passing therethrough, to move the plasma fluid in the downstream direction. According to the Lorentz force, the plasma is accelerated in the downstream direction and ejected from the acceleration channel 102 to produce a thrust equal to a reaction force against the ejection.

The acceleration mechanism will be more specifically described. An electron E33 and a propellant ion P33 in FIG. 3 constitute plasma. The electron E33 is moved in the circumferential direction due to the E×B drift during the Larmor motion around the magnetic line of the magnetic field B. A current J flows in the opposite direction of the drift direction. The plasma with the current J passing therethrough is subject to a Lorentz force generated by the interaction with the magnetic field B, and moved in the downstream direction. Thus, the plasma including the electron E33 and the propellant ion P33 is accelerated and ejected from the downstream end of the acceleration channel 102 to produce a thrust equal to a reaction force against the ejection. In this electromagnetic acceleration model, plasma is primarily generated in the plasma generation section or the upstream region of the acceleration channel 102, as with the aforementioned mechanism in the electrostatic acceleration model. Specifically, an electron 31 accelerated in the upstream region of the acceleration channel 102 collides with a propellant neutral particle N32 to dissociate the propellant neutral particle N32 into an electrode E32 and a propellant ion P32 so as to generate plasma.

As above, the acceleration model of the conventional Hall-effect plasma accelerator has been described based on the electrostatic acceleration model and the electromagnetic acceleration model. In either model, the conventional Hall-effect plasma accelerator is designed such that both the plasma generation and the propellant-ion acceleration are achieved by the DC electric field applied in the axial direction of the acceleration channel. This type of Hall-effect plasma accelerator is called a single-stage Hall-effect plasma accelerator. As mentioned above, the intensity of the magnetic field is required to be set at a relatively high value in the acceleration section and at a relatively low value in the plasma generation section. That is, the acceleration and plasma generation sections are different in desired characteristic of the magnetic field intensity. Further, the acceleration and plasma generation sections have to be located adjacent to one another. Furthermore, in order to keep balance in orbit of accelerated/ejected propellant ions, it is desirable that the magnetic field rapidly disappears at the outlet of the acceleration channel 102. That is, it is generally desirable to arrange the intensity of the radial magnetic field in such a manner as to be moderately increased from a zero value up to a maximum value in the axial direction from the upstream region to the downstream region of the acceleration channel 102, and rapidly vanished just after going beyond a position having the maximum value. The design of magnetic field is a critical factor in achieving enhanced performance of the single-stage Hall-effect plasma accelerator, and various efforts have been made for this purpose (see, for example, the following Non-Patent Publications 2 to 5)

Non-Patent Publication 1: Kuriki and Arakawa, "Introduction to Electric Propulsion Rocket", University of Tokyo Press, Chapter VII Non-Patent Publication 2: A. I. Morozov, Yu. V. Esipchuk, A. M. Kapulkin, V. A. Nevrovskii, and V. A. Smirnov, "Effect of A. I. Bugrova, A. D. Desitskov, V. K. Kharchevnikov, M. Prioul and L. Jolivet, "Research of the Magnetic Field on a Closed-Electron-Drift Accelerator", Soviet Physics Technical Physics, Vol. 17, No. 3, 1972, pp. 482

Non-Patent Publication 3: A. I. Morozov, Yu. V. Esipchuk, G. N. Tilinin, A. V. Trofimov, Yu. A. Sharov and G. Ya. Shchepkin, "Plasma Acceleration with Closed Electron Drift and Extended Acceleration Zone", Soviet Physics Technical Physics, Vol. 17, No. 1, 1972, pp. 38

Non-Patent Publication 4: V. M. Gavryushin and V. Kim, "Effect of the Characteristics of a Magnetic Field on the parameters of an Ion Current at the Output of an Acceleration with Closed Electron Drift", Soviet Physics Technical Physics, Vol. 26, No. 4, 1981, pp.504

Non-Patent Publication 5: A. M. Bishaev and V. Kim, "Local Plasma Properties in a Hall-Current Accelerator with an Extended Acceleration Zone", Soviet Physics Technical Physics, Vol. 23, No. 9, 1978, pp. 1055

The objective of producing the above optimal magnetic field (magnetic flux) cannot be achieved without using a complicated structure in a magnetic circuit, electromagnetic coil, magnet, magnetic shielding (magnetic screen) and/or magnetic shunt device, which leads to increase in weight undesirable from the standpoint of a space system. Moreover, a magnetic-field based system is liable to cause deterioration in performance due to temperature rise. The single-stage Hall-effect plasma accelerator to be subjected to high temperatures originally has difficulties in achieving such desirable characteristics.

There have been known a number of patent applications as the result of proposals and researches on magnetic-field design for solving the above problems (see, for example, the following Patent Publications 1 to 13)

Patent Publication 1: Japanese Patent Laid-Open Publication No. 2002-516644 [Titled "Hall-effect Plasma Thruster": This invention relates to a single-stage Hall-type accelerator, and a magnetic-field circuit design using a hollow annular magnetic body.]

Patent Publication 2: Japanese Patent Laid-Open Publication No. 2002-504968 [Titled "Hall-effect Plasma Thruster": This invention relates to a single-stage Hall-type accelerator, and a technique for controlling an ejected ion beam direction by circumferentially-divided solenoid coils.]

Patent Publication 3: Japanese Patent Laid-Open Publication No. 2001-521597 [Titled "Hall-effect Plasma Accelerator": This invention relates to a single-stage Hall-type accelerator, and a technique using circumferentially-divided solenoid coils.]

Patent Publication 4: Japanese Patent Laid-Open Publication No. 05-240143 (Patent No. 2651980) [Titled "Plasma Accelerator with Closed Electron Drift": This invention relates to a technique for providing an optimal magnetic field configuration by use of a magnetic path and a magnetic screen, to a single-stage Hall-type accelerator.]

Patent Publication 5: Japanese Patent Laid-Open Publication No. 2002-517661 [Titled "Formation of Magnetic Field in Ion Accelerator using Closed Electron Drift": This invention relates to a single-stage Hall-type accelerator, and a technique for providing an optimal magnetic field by use of a magnetic shunt device.]

Patent Publication 6: Japanese Patent Laid-Open Publication No. 11-297497 [Titled "Plasma Accelerator with Closed Electron Drift and Conductive Insert": This invention relates to a single-stage Hall-type accelerator.]

Patent Publication 7: Japanese Patent Laid-Open Publication No. 11-505058 [Titled "Closed-Electron-Drift based Plasma Accelerator": This invention relates to a single-stage Hall-type accelerator.]

Patent Publication 8: Japanese Patent Laid-Open Publication No. 08-500930 [Titled "Plasma Accelerator with Closed Electron Drift": This invention relates to a single-stage Hall-type accelerator.]

Patent Publication 9: Japanese Patent Laid-Open Publication No. 08-500699 [Titled "Short Plasma Accelerator with Closed Electron Drift": This invention relates to a single-stage Hall-type accelerator.]

Patent Publication 10: Japanese Patent Laid-Open Publication No. 08-500930 (Patent No. 3083561) [Titled "Plasma Accelerator with Closed Electron Drift": This invention relates to a single-stage Hall-type accelerator.]

Patent Publication 11: Japanese Patent Laid-Open Publication No. 04-229996 (Patent No. 2961113) [Titled "Plasma Accelerator with Closed Electron Drift": This invention relates to a single-stage Hall-type accelerator, and a technique for reflecting ions by an electrode provided in an acceleration section to achieve reduction in loss.]

Patent Publication 12: Japanese Patent No. 2895472 [Titled "Plasma Accelerator with Closed Electron Drift and Conductive Insert": This invention relates to a single-stage Hall-type accelerator, and a technique for correcting an ion beam orbit by an electrode provided in an outlet region.]

Patent Publication 13: Japanese Patent Laid-Open Publication No. 2000-073937 [Titled "Closed-Electron-Drift Plasma Thruster adaptable to High-Temperature Load": This invention relates to a single-stage Hall-type accelerator, and a technique for a magnetic-field design.]

As above, a number of patent applications on the technique for a magnetic-field design have been filed. All of these inventions relates to a magnetic-field design, but cannot fundamentally solve the difficulties in the magnetic-field design.

In single-stage Hall-effect plasma accelerators, a single DC power source is used for both the plasma generation and the ion acceleration. The distribution of electric power for contributing to each of the plasma generation and the ion acceleration is determined by the configuration of an intended magnetic field. Thus, it is difficult to control the power distribution in an active manner. This makes it difficult to control the Hall-effect plasma accelerator to be an optimal operational state capable of achieving an efficient operation Further, in the single-stage Hall-effect plasma accelerators, the plasma generation and the ion acceleration are successively performed, and thereby the ratio between the plasma generation and the ion acceleration is likely to be unable to be maintained at a constant value. In connection with this problem, there has been known an undesirable phenomenon, the so-called "discharge plasma fluctuation phenomena" (see, for example, the Non-Patent Publication 1). The occurrence of an intensive discharge plasma fluctuation is likely to spoil a stable operation as the thruster, and preclude the continuation of the operation in the worst case In the single-stage Hall-effect plasma accelerators, a total propulsion efficiency $\eta$ is expressed by the following formula:

$$\eta=\eta_u\eta_{ex}^2\eta_v\eta_l\eta_{el}$$

wherein:

$\eta_u$ is a propellant-use efficiency $$\left(\eta_u = \frac{\dot{m}_{ex}}{\dot{m}},\right.$$

wherein $\dot{m}$ is a propellant supply ratio to an electric propulsion system, and $\dot{m}_{ex}$ is an effective propellant weight ejection ratio contributing to thrust);

$\eta_{ex}$ is an ejected beam efficiency $$\left(\eta_{ex} = \frac{v_{ex}}{v},\right.$$

wherein $v$ is an actual velocity of a beam to be accelerated/ejected from the electric propulsion system, and $v_{ex}$ is an effective ejection velocity contributing to thrust);

$\eta_v$ is a voltage efficiency $$\left(\eta_V = \frac{V_b}{V_b + C_i + C_n} = \frac{V_b}{V_d + C_n},\right.$$

wherein: $V_b$ is an effective acceleration voltage corresponding to the ejection velocity $v$; $C_i$ is an ion generation cost; and $C_n$ is a neutralization cost);

$\eta_l$ is a current efficiency $$\left(\eta_I = \frac{I_b}{I_b + I_e} = \frac{I_b}{I_d},\right.$$

wherein: $I_b$ is a beam current equivalent to an ejected ion current; $I_e$ is a reverse-flow electron current in a discharge current; and $I_d$ is a total discharge current); and $\eta_{el}$ is a power source efficiency.

The ejected beam efficiency includes a loss effect due to beam divergence and a thrust loss due to lowering in specific charge caused by bivalent ionized ions.

Each of the above parameters has to be enhanced to improve the total propulsion efficiency. As seen from the above formula, if the electron current $I_e$ expressed in the denominator of the current efficiency $\eta_l$ is increased, the current efficiency will be deteriorated. However, the conventional single-stage Hall-effect plasma accelerators inevitably have a poor current efficiency due to the reverse flow of electrons emitted from the cathode.

In order to solve the above problems so as to extend an operating range (power range, variable thrust, variable specific thrust), researches on a two-stage Hall-effect plasma accelerator having two independent power sources, respectively, for the plasma generation and ion acceleration sections have been made (see, for example, the following Non-Patent Publications 6 and 7).

Non-Publication 6: Y Yamagiwa and K. Kuriki, "Performance of Double-Stage-Discharge Hall Ion Thruster", Journal of Propulsion and Power, Vol. 7, No. 1, 1991, pp. 65

Non-Publication 7: A. I. Morozov, A. I. Bugrova, A. D. Desitskov, V. K. Kharchevnikov, M. Prioul and L. Jolivet, "Research on Two-Stage Engine SPT-MAG", IEPC03-290, International Electric Propulsion Conference, 2003, France These two-stage Hall-effect plasma accelerators are intended to independently control respective voltages to be applied between electrodes designed for each purpose of the plasma generation and the ion acceleration, so as to achieve an optimal operational state. In this system, a DC electric field is used for each of the plasma generation and the ion acceleration. Thus, in a practical sense, even if two independent DC sources are provided to apply different voltages for each of the plasma generation and the ion acceleration, it is significantly difficult to control the plasma generation and the ion acceleration independently. Specifically, even if two independent voltages are separately applied, for example, to the upstream and downstream regions of an acceleration channel, the plasma generation and the ion acceleration will be mixedly performed in the continuous acceleration channel. Thus, a part of voltage applied for the plasma generation inevitably contributes to the ion acceleration, and a part of voltage applied for the ion acceleration inevitably contributes to the plasma generation. Consequently, in terms of actual performances, these two-stage Hall-effect plasma accelerators are hardly discriminated from the single-stage Hall-effect plasma accelerators. Further, while the two-stage Hall-effect plasma accelerators can provide enhanced current efficiency because of no need to generate the reverse flow of electrons for the plasma generation, additional components, such as a second power source, have to be introduced, and an efficiency factor required for the additional components will appear as the ion generation cost $C_i$ in the denominator of the voltage efficiency $\eta_v$. Further, the propulsion efficiency is determined by the balance between the improvement in the current efficiency $\eta_l$, and the deterioration in the voltage efficiency $\eta_v$. Thus, this two-stage structure cannot automatically lead to improvement in the propulsion efficiency. Due to these circumstances, despite of the above efforts, a desirably improved performance of Hall-effect plasma accelerators has not been achieved at this moment.

In view of the above conventional problems, it is therefore an object of the present invention to provide a high-frequency discharge plasma generation-based two-stage Hall-effect plasma accelerator with an ion acceleration section for accelerating ions and a high-frequency wave supply section for generating plasma, capable of controlling the ion acceleration and the plasma generation in a highly independent manner.

SUMMARY OF THE INVENTION

In order to achieve the above object, according to a first aspect of the present invention, there is provided a high-frequency discharge plasma generation-based two-stage Hall-effect plasma accelerator which comprises an ion acceleration section, and a high-frequency wave supply section for supplying a high-frequency wave to the ion acceleration section. The ion acceleration section includes: an annular acceleration channel comprising two concentric cylindrical structures different in radius, which have a first end formed as an open end for ejecting an ion therefrom and a second, opposite, end located adjacent to the high-frequency wave supply section, and a space defined between the concentric cylindrical structures; a gas inlet port connected to the annular acceleration channel at a position adjacent to the high-frequency wave supply section to introduce a plasma-generating gas from the outside to the inside of the annular acceleration channel; an anode disposed in the space of the annular acceleration channel at a position adjacent to the high-frequency wave supply section; a cathode disposed in the vicinity of the first open end of the annular acceleration channel and adapted to have an acceleration voltage to be applied at a given level with respect to the anode; a neutralizing electron generation portion adapted to generate an electron for neutralizing the ion ejected from the annular acceleration channel; magnetic-field generation means for generating a magnetic field having a given intensity distribution in the radial direction from the central axis of the annular acceleration channel; and high-frequency wave generation means for generating a high-frequency wave to be introduced in the space of the annular acceleration channel, whereby: the plasma-generating gas introduced from the gas inlet port into the space of the annular acceleration channel is ionized by the high-frequency wave supplied from the high-frequency wave supply section to generate plasma; a positive ion included in the generated plasma is accelerated in the space of the annular acceleration channel toward the first open end by the acceleration voltage applied between the anode and the cathode, and ejected outside; and an electron included in the generated plasma is restricted in its movement in the axial direction of the concentric cylindrical structures by an interaction with the radial magnetic field. The high-frequency wave supply section includes high-frequency wave introduction means for introducing the high-frequency wave generated by the high-frequency wave generation means, into the space of the annular acceleration channel. In the above two-stage Hall-effect plasma accelerator, the ion acceleration section is operable to control a degree of the ion acceleration in accordance with the acceleration voltage serving as an acceleration control parameter, and the high-frequency wave supply section is operable to control an amount of the plasma generation in accordance with the high-frequency wave output serving as a plasma-generation control parameter to be controlled independently of the acceleration control parameter.

In the two-stage Hall-effect plasma accelerator set forth in the first aspect of the present invention, the high-frequency wave supply section may further include a cavity portion disposed adjacent to the second end of the concentric cylindrical structures, and formed with a cavity adapted to allow a high-frequency wave to be introduced therein. In this case, the high-frequency wave introduction means may be operable to introduce a high-frequency wave into the cavity of the cavity portion to thereby introduce the high-frequency wave into the space of the annular acceleration channel.

The cavity portion may serve as a cavity resonator for inducing resonance in the high-frequency wave introduced in the cavity.

In this two-stage Hall-effect plasma accelerator, the high-frequency wave supply section may further include a high-frequency-wave transmitting window portion disposed between the cavity portion and the second end of the concentric cylindrical structures. The high-frequency-wave transmitting window portion may be made of a material capable of transmitting a high-frequency wave therethrough, and adapted to prevent the plasma-generating gas from permeating therethrough.

The two-stage Hall-effect plasma accelerator set forth in the first aspect of the present invention may further include resonating magnetic field generation means disposed on the opposite side of the second open end of the annular acceleration channel with respect to the high-frequency wave introduction means, and adapted to induce electron cyclotron resonance when a high-frequency wave having an electron cyclotron resonance frequency is introduced therein, whereby the high-frequency wave introduced into the space of the annular acceleration channel by the high-frequency wave introduction means ionizes the plasma-generating gas at a position corresponding to the magnetic field formed by resonating magnetic field generation means, in accordance with the electron cyclotron resonance.

The resonating magnetic field generation means may be operable to form a mirror field for confining plasma therewithin.

The two-stage Hall-effect plasma accelerator set forth in the first aspect of the present invention may be designed to allow inactive plasma to be led to the vicinity of the anode.

According to a second aspect of the present invention, there is provided a space propulsion engine comprising the two-stage Hall-effect plasma accelerator set forth in the first aspect of the present invention. In this space propulsion engine, the plasma-generating gas is a propellant.

According to a third aspect of the present invention, there is provided an ion acceleration apparatus comprising the two-stage Hall-effect plasma accelerator set forth in the first aspect of the present invention. In this ion acceleration apparatus, the plasma-generating gas is an ion source.

According to a fourth aspect of the present invention, there is provided a plasma etching apparatus comprising the two-stage Hall-effect plasma accelerator set forth in the first aspect of the present invention. In this plasma etching apparatus, the plasma-generating gas is an ion source for sputtering.

According to a fifth aspect of the present invention, there is provided an ion acceleration apparatus for use on the ground, which comprises a high-frequency discharge plasma generation-based two-stage Hall-effect plasma accelerator, and a beam target. The two-stage Hall-effect plasma accelerator has an ion acceleration section, and a high-frequency wave supply section for supplying a high-frequency wave to the ion acceleration section. The ion acceleration section includes: an annular acceleration channel comprising two concentric cylindrical structures different in radius, which have a first end formed as an open end for ejecting an ion therefrom and a second, opposite, end located adjacent to the high-frequency wave supply section, and a space defined between the concentric cylindrical structures; a gas inlet port connected to the annular acceleration channel at a position adjacent to the high-frequency wave supply section to introduce a plasma-generating gas serving as an ion source, from the outside to the inside of the annular acceleration channel; an anode disposed in the space of the annular acceleration channel at a position adjacent to the high-frequency wave supply section; magnetic-field generation means for generating a magnetic field having a given intensity distribution in the radial direction from the central axis of the annular acceleration channel; and high-frequency wave generation means for generating a high-frequency wave to be introduced in the space of the annular acceleration channel. The beam target is disposed in the vicinity of the first open end of the annular acceleration channel and adapted to have an acceleration voltage to be applied at a given level with respect to the anode. Based on the above structure, the plasma-generating gas introduced from the gas inlet port into the space of the annular acceleration channel is ionized by the high-frequency wave supplied from the high-frequency wave supply section to generate plasma; a positive ion included in the generated plasma is accelerated in the space of the annular acceleration channel toward the first open end by the acceleration voltage applied between the anode and the beam target, and ejected toward the beam target; and an electron included in the generated plasma is restricted in its movement in the axial direction of the concentric cylindrical structures by an interaction with the radial magnetic field. Further, the high-frequency wave supply section includes high-frequency wave introduction means for introducing the high-frequency wave generated by the high-frequency wave generation means, into the space of the annular acceleration channel. In the ion acceleration apparatus, the ion acceleration section is operable to control a degree of the ion acceleration in accordance with the acceleration voltage serving as an acceleration control parameter, and the high-frequency wave supply section is operable to control an amount of the plasma generation in accordance with the high-frequency wave output serving as a plasma-generation control parameter to be controlled independently of the acceleration control parameter.

According to a sixth aspect of the present invention, there is provided a plasma etching apparatus which comprises a high-frequency discharge plasma generation-based two-stage Hall-effect plasma accelerator, and a beam target. The two-stage Hall-effect plasma accelerator has an ion acceleration section, and a high-frequency wave supply section for supplying a high-frequency wave to the ion acceleration section. The ion acceleration section includes: an annular acceleration channel comprising two concentric cylindrical structures different in radius, which have a first end formed as an open end for ejecting an ion therefrom and a second, opposite, end located adjacent to the high-frequency wave supply section, and a space defined between the concentric cylindrical structures; a gas inlet port connected to the annular acceleration channel at a position adjacent to the high-frequency wave supply section to introduce a plasma-generating gas serving as an ion source for sputtering, from the outside to the inside of the annular acceleration channel; an anode disposed in the space of the annular acceleration channel at a position adjacent to the high-frequency wave supply section; magnetic-field generation means for generating a magnetic field having a given intensity distribution in the radial direction from the central axis of the annular acceleration channel; and high-frequency wave generation means for generating a high-frequency wave to be introduced in the space of the annular acceleration channel. The beam target is disposed in the vicinity of the first open end of the annular acceleration channel and adapted to have an acceleration voltage to be applied at a given level with respect to the anode. Based on the above structure, the plasma-generating gas introduced from the gas inlet port into the space of the annular acceleration channel is ionized by the high-frequency wave supplied from the high-frequency wave supply section to generate plasma; a positive ion included in the generated plasma is accelerated in the space of the annular acceleration channel toward the first open end by the acceleration voltage applied between the anode and the beam target, and ejected toward the beam target; and an electron included in the generated plasma is restricted in its movement in the axial direction of the concentric cylindrical structures by an interaction with the radial magnetic field. Further, the high-frequency wave supply section includes high-frequency wave introduction means for introducing the high-frequency wave generated by the high-frequency wave generation means, into the space of the annular acceleration channel. In the plasma etching apparatus, the ion acceleration section is operable to control a degree of the ion acceleration in accordance with the acceleration voltage serving as an acceleration control parameter, and the high-frequency wave supply section is operable to control an amount of the plasma generation in accordance with the high-frequency wave output serving as a plasma-generation control parameter to be controlled independently of the acceleration control parameter.

In the present invention, the terms defining physical components, such as "anode", "cathode", and "annular acceleration channel" are not intended to express a specific configuration or appellative of an element, device or mechanism, but to express a general function of each physical component.

Each of the above inventions defined by a product claim may be figured out as a method in which respective functions of structural elements of the invention are sequentially executed. In this case, the execution sequence of the structural elements is not limited to the order of description, but the structural elements may be executed in an arbitrary sequence as long as the entire function can be achieved without contradiction. Further, a function of a single means may be achieved by two or more physical components, and a plurality of functions of two or more means may be achieved by a single physical component. Similarly, a function of a single step may be achieved by two or more steps; and a plurality of functions of two or more steps may be achieved by a single step.

Figure 1:
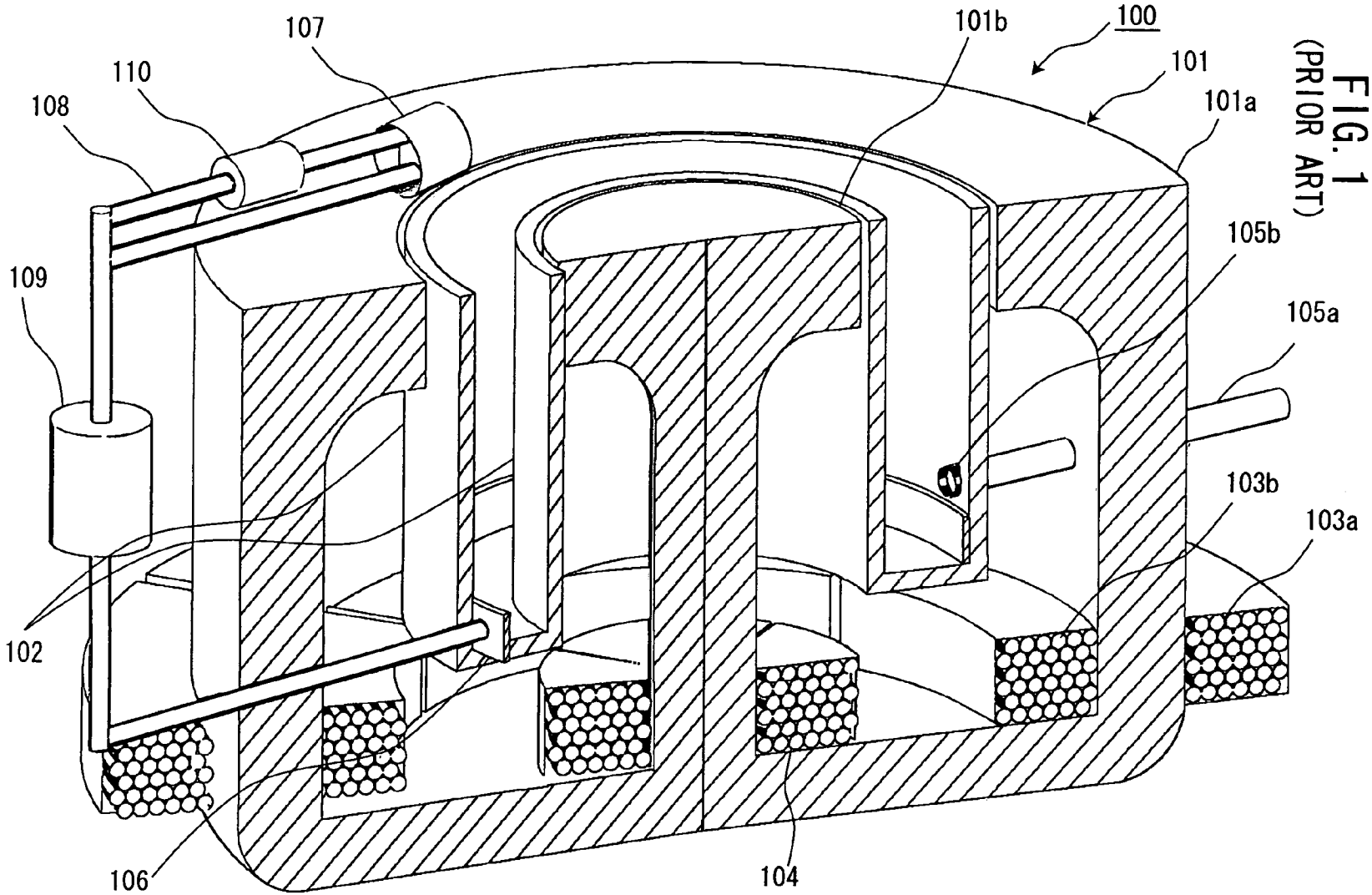
FIG. 1 (PRIOR ART)
FIG. 1 is a partially cutaway perspective sectional view showing the structure of a conventional Hall-effect plasma accelerator 100.

100: Hall-effect plasma accelerator
101: pole piece
102: acceleration channel
103*a*: coil
103*b*: coil
104: coil
105*a*: propellant feed port
105*b*: propellant discharge port
106: anode
107: cathode
108: wiring
109: acceleration power source
110: neutralizer power source
200: high-frequency discharge plasma generation-based two-stage Hall-effect plasma accelerator
201: pole piece
202: acceleration channel
203*a*: coil
203*b*: coil
204: coil
205*a*: propellant feed port
205*b*: propellant discharge port
206: anode
207: cathode
208: wiring
209: acceleration power source
210: neutralizer power source
211: cavity resonator
212: high-frequency wave transmitting window portion
213: waveguide
214: high-frequency wave introduction probe
215: high-frequency oscillator
300: two-stage Hall-effect plasma accelerator
301: pole piece
302: acceleration channel
303*a*: coil
303*b*: coil
304: coil
305*a*: propellant feed port
305*b*: propellant discharge port
306: anode
307: cathode
208: wiring
309: acceleration power source
310: neutralizer power source
313: waveguide
314: high-frequency wave introduction probe
315: high-frequency wave oscillator
350: plasma generation mechanism model
351: permanent magnet
352: magnetic field of 0.21 T
353: mirror field
354: ECR region
355: electron
356: Larmor electron motion
357: mirror field reflection region
358: electron trajectory

BEST MODE FOR CARRYING OUT THE INVENTION

With reference to the drawings, a high-frequency discharge plasma generation-based two-stage Hall-effect plasma accelerator 200 according to one embodiment of the present invention (hereinafter referred to as "two-stage Hall-effect plasma accelerator 200" for brevity) will now be described.

Figure 4:
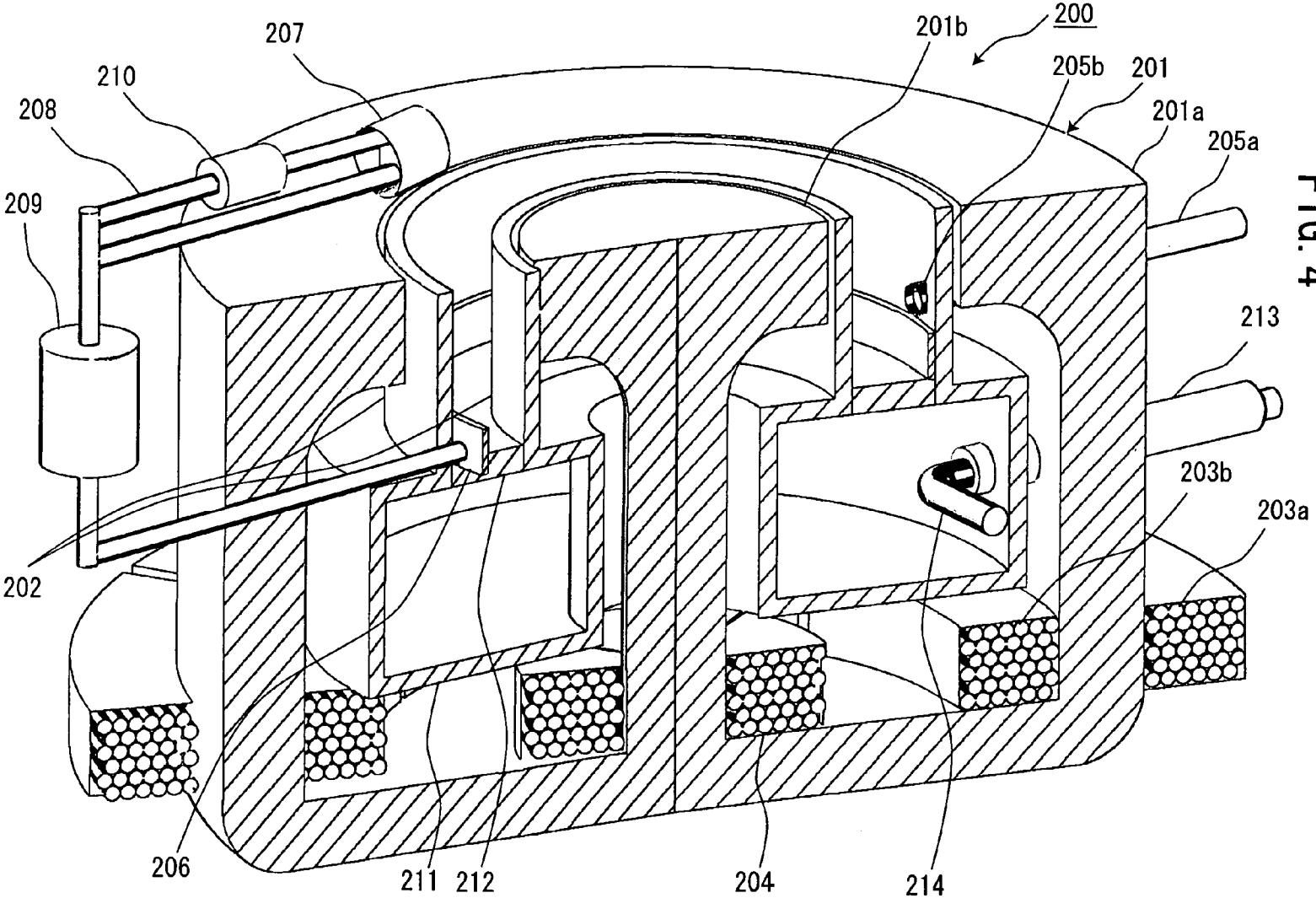
FIG. 4 is a partially cutaway perspective sectional view showing the structure of a high-frequency discharge plasma generation-based two-stage Hall-effect plasma accelerator 200 according to one embodiment of the present invention.
Figure 7:
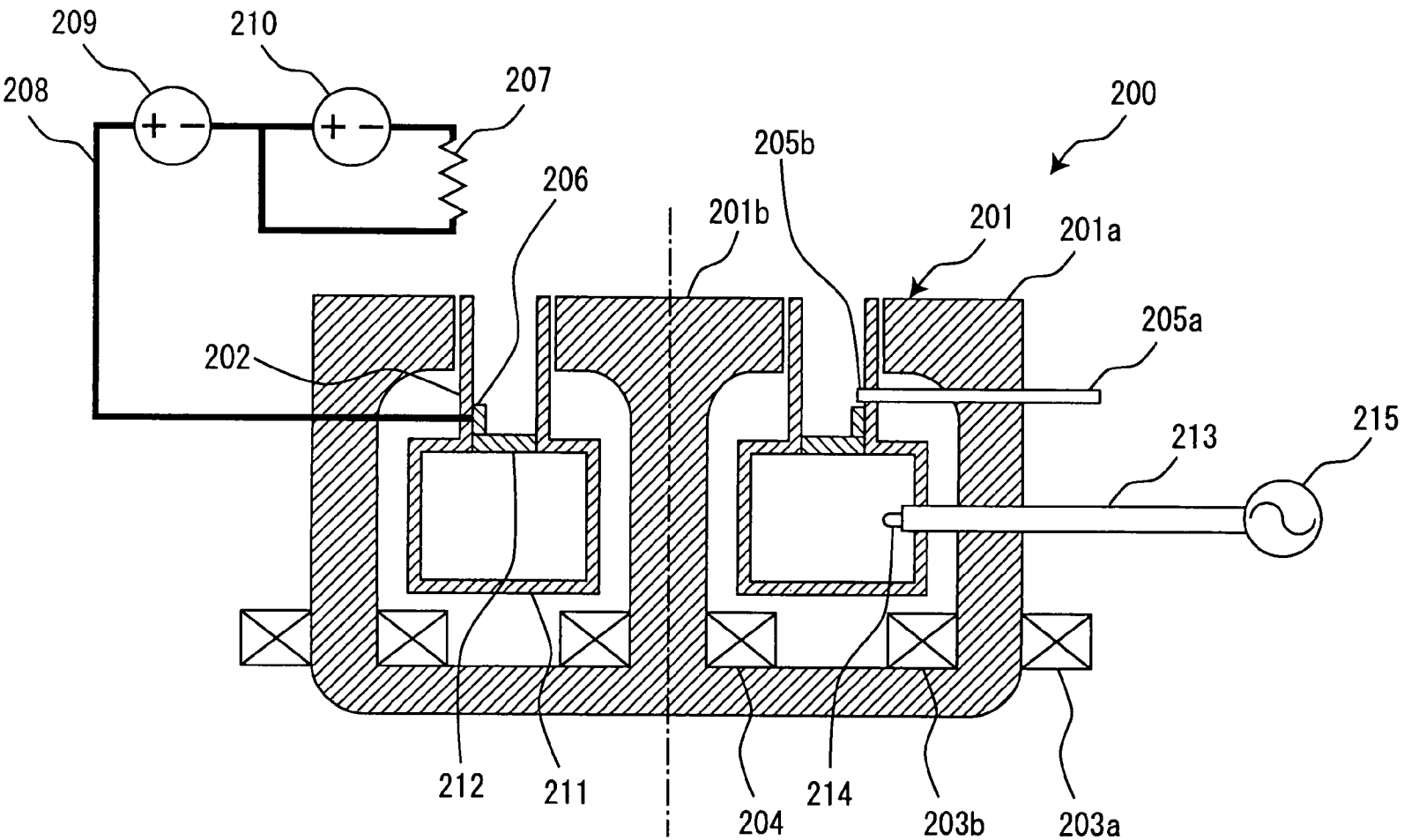
FIG. 7 is a combinational diagram of an electric circuit and a schematic section of the high-frequency discharge plasma generation-based two-stage Hall-effect plasma accelerator 200.

FIG. 4 is a partially cutaway perspective sectional view showing the structure of the two-stage Hall-effect plasma accelerator 200. FIG. 7 is a combinational diagram of an electric circuit and a schematic section of the two-stage Hall-effect plasma accelerator 200. The two-stage Hall-effect plasma accelerator 200 comprises a pole piece 201, an acceleration channel 202, a coil 203*a*, a coil 203*b*, a coil 204, a propellant feed port 205*a*, a propellant discharge port 205*b*, an anode 206, a cathode 207, a wiring 208, an acceleration power source 209, a neutralizer power source 210, a cavity resonator 211, a high-frequency wave transmitting window portion 212, a waveguide 213, a high-frequency wave introduction probe 214 and a high-frequency oscillator (not shown in FIG. 4). In the two-stage Hall-effect plasma accelerator 200 illustrated in FIG. 4, each of the elements or components corresponding to those of the conventional Hall-effect plasma accelerator 100 is defined by a reference numeral derived by adding 100 to the reference numeral of the conventional Hall-effect plasma accelerator 100.

The pole piece 201 is adapted to guide magnetic field lines generated by the coils 203*a*, 203*b*, 204 in such a manner that a magnetic field is distributed over the acceleration channel 202 in a suitable configuration for accelerating ions. The pole piece 201 is composed of an outer pole piece 201*a* and an inner pole piece 201*b*, and designed to induce magnetic field lines primarily in an air gap between the inner and outer pole piece in a desired configuration. A major difference with the conventional Hall-effect plasma accelerator 100 is in that the magnetic field distribution in the acceleration channel 202 may be designed to have a suitable configuration for the ion acceleration without any regard for generation of plasma. Thus, the requirement for the magnetic field distribution is eased as compared to the conventional Hall-effect plasma accelerator 100. This is one advantage of using a high-frequency wave for the plasma generation, as will be described in detail later. The anode 206 is placed at an upstream end of the acceleration channel 202 on the opposite side of an outlet of the acceleration channel 102, and adapted to cooperate with the cathode 207 disposed in the vicinity of the downstream outlet to generate an electric field therebetween, and accelerate ions residing in the acceleration channel 202 by the electric field. The acceleration channel 202 optimally comprises two concentric cylindrical structures different in radius, and a space defined between the concentric cylindrical structures. The term "two concentric cylindrical structures different in radius" herein does not mean that each of the structures has a perfect cylindrical shape, but that the structures comprise outer and inner cylinders for defining a channel with an approximately constant width (or an orderly or steady width) therebetween. The coils 203*a*, 203*b*, 204 are adapted to receive an electric power from an appropriate power source (not shown) to generate a magnetic field. The propellant feed port 205*a* an inlet for introducing a propellant, such as xenon gas, inside the Hall-effect plasma accelerator 200. The introduced propellant will be discharged from the propellant discharge port 205*b* into the acceleration channel 202. The acceleration power source 209 is adapted to generate a given voltage and apply the voltage between the anode 206 and the cathode 207 through the wiring 208. In this case, a positive voltage relative to the cathode 207 is applied to the anode 206. This voltage acts for the ion acceleration almost without contributing to the plasma generation, as will be described in detail later. Thus, this applied voltage serves as an ion acceleration voltage, and makes it possible to control the ion acceleration independently of the plasma generation. The anode 206 having no contribution to the plasma generation may be designed to have a minimized area. The anode 206 having a large area is likely to cause wear damage therein due to contact with generated active plasma. In the present invention, the area of the anode 206 can be minimized. This makes it possible to use inactive plasma as local plasma in the vicinity of the anode 206 so as to effectively prevent the wear damage in the anode 206.

The cavity resonator 211 is formed at the end of the acceleration channel 202 on the side of the anode 206, through the high-frequency wave transmitting window portion 212. The high-frequency wave transmitting window portion 212 is made of a material capable of transmitting a high-frequency wave therethrough and preventing the propellant gas from permeating therethrough, such as glass or ceramic. The high-frequency wave transmitting window portion 212 can prevent active plasma or reactive gas from contacting a plasma-generating energy supply portion, such as a high-frequency wave introduction probe 214, to cause wear damage in the plasma-generating energy supply portion and/or contamination of the plasma. While the conventional single-stage Hall-effect plasma accelerator designed to generate plasma around the anode cannot avoid the ware damage of the anode and/or contamination of the plasma, the present invention employing electrodeless discharge on the side of the anode is free from the occurrence of such phenomena in principle.

The cavity resonator 211 may be formed as various types for inducing resonance (sympathetic vibration) in a high-frequency wave to be introduced. A high-frequency oscillator (high-frequency wave generation means) (see FIG. 7) is adapted to be supplied with an electric power independently of the acceleration power source 209 so as to generate a high-frequency wave. Preferably, the high-frequency wave to be generated is a microwave. This high-frequency wave acts to ionize propellant gas but has no contribution to the ion acceleration. That is, the high-frequency wave output serves as energy for ionization, and makes it possible to control the plasma generation independent of the ion acceleration. The generated high-frequency wave is firstly introduced into the waveguide 213. The waveguide 213 may be another type of electromagnetic wave transmitting means, such as a coaxial cable. The introduced high-frequency wave is emitted from the high-frequency wave introduction probe 214 into the cavity resonator 211, and resonated (sympathetically vibrated) in the cavity resonator 211. According to this resonance in the microwave, a voltage magnitude of the high-frequency wave introduced in the cavity resonator 211 can be adjusted (preferably amplified) to stably supply energy to plasma. As one alternative, a simple cavity portion may be used in place of the cavity resonator 211. The high-frequency wave in the cavity resonator 211 is supplied to the space of the acceleration channel 202 through the high-frequency wave transmitting window portion 212. The microwave supplied to the space of the acceleration channel 202 exerts an ionization effect on a propellant (xenon gas etc.) residing in the space. In view of control of a plasma generation region, the high-frequency wave is preferably arranged to have a higher frequency to facilitate localization of the plasma generation. In this microwave discharge mode, the electric field of the microwave is intensified by the cavity resonator 211, and then a part of the microwave is extracted from the microwave transmitting window portion 212 to accelerate electrons within a short time of period. While the moving direction of the accelerated electron is reversed by elastic collision with a neutral particle, the efficiency of the electron acceleration will be enhanced if a cycle of the reversal becomes equal to a frequency of the microwave. This can be achieved by setting the density of propellant gas at a relatively high value. This high-frequency discharge mode will hereinafter be referred to as "non-resonance discharge". In this mode, the configurations of the cavity resonator 211, the high-frequency wave transmitting window portion 212, etc., may be appropriately designed to have the configuration of a microwave launcher. In this case, a high-frequency beam can be supplied to the space of the acceleration channel in a desired beam configuration to generate plasma at a desired position. Further, a position of the plasma generation is determined by an input position of the high-frequency wave. Thus, the need for an accurate magnetic field design and associated technique can be eliminated. Specifically, a magnetic field design can be adequately performed by optimizing only the ion acceleration without the need for taking account of the plasma generation. This makes it possible to provide high flexibility of the design, and achieve reductions in weight, cost, and resource, such as development resource. The high-frequency wave supply mechanism may be designed to be adjustable by changing the configuration of the high-frequency wave introduction probe (antenna) 214 or changing the propagation mode of the high-frequency wave (whether a surface wave is used), or by appropriately using an applicator, so as to achieve a desired plasma generation characteristic. The high-frequency wave is locally input at a position adjacent to a magnetic field region adequately configured only for the ion acceleration. This allows ions contained in plasma generated by the high-frequency wave to be efficiently led to the acceleration region.

The high-frequency discharge-based plasma generation is primarily performed around the end of the acceleration channel 22 located on the side of the anode 206 and adjacent to the cavity resonator 211. As one modification, the high-frequency wave transmitting window portion 212 disposed between the cavity resonator 211 and the end of the acceleration channel on the side of the anode 206 may be omitted. One example of such a structure is shown in the aftermentioned another embodiment of the present invention. A propellant ion included in the generated plasma is accelerated toward the open end of the acceleration channel 202 by the electric field generated by the acceleration voltage applied between the anode 206 and the cathode 207, and ejected from the open end.

The cathode 207 also acts as a hot cathode, or neutralizer, for emitting electrons to neutralize the charge of the ejected propellant ions. The neutralizer power source 210 is adapted to supply an electric power for heating the hot electrode, to the cathode 207.

The relationship between structural elements in the appended claims and the components of the two-stage Hall-effect plasma accelerator 200 is as follows: an annular acceleration channel corresponds to the acceleration channel 202; a gas inlet port corresponds to the propellant discharge port 205*a*; an anode corresponds to the anode 206; a cathode corresponds to the cathode 207; a neutralizing electron generation portion corresponding to the cathode 207 and the neutralizer power source 210; magnetic-field generation means corresponds to the pole piece 201 and the coils 203*a*, 203*b*, 204; high-frequency wave generation means corresponds to the high-frequency oscillator 215; high-frequency wave introduction means corresponds to the waveguide 213 and the high-frequency introduction probe 214, an acceleration voltage serving as an acceleration control parameter corresponds to a voltage to be generated by the acceleration power source 209, and a high-frequency wave output serving as a plasma-generation control parameter corresponds to a high-frequency wave to be generated by the high-frequency oscillator 215.

Figure 5:
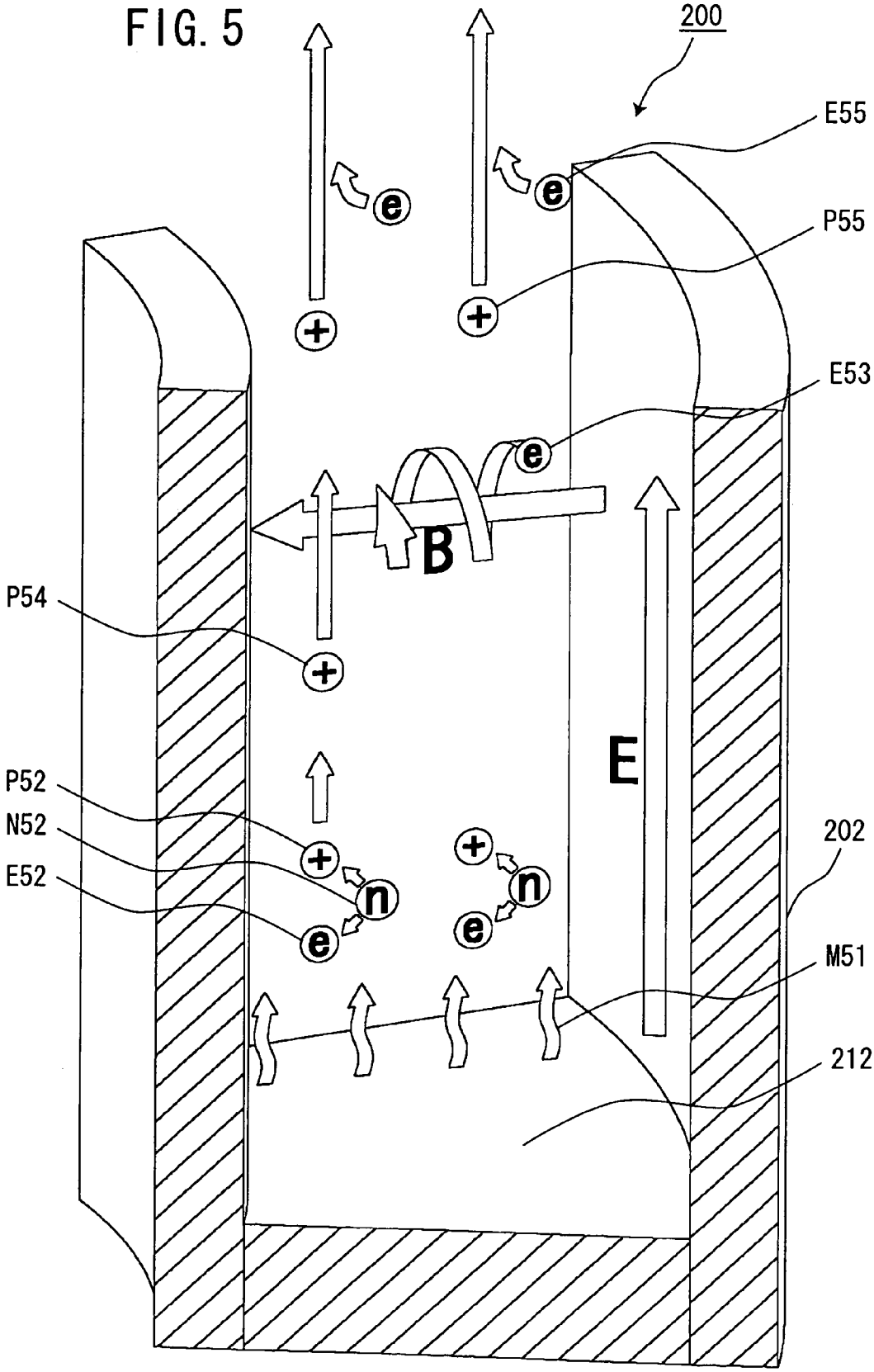
FIG. 5 is a conceptual explanatory diagram of an electrostatic acceleration model-based acceleration mechanism of the high-frequency discharge plasma generation-based two-stage Hall-effect plasma accelerator 200.

A plasma generation mechanism and an ion acceleration mechanism in the above two-stage Hall-effect plasma accelerator 200 will be described below. Firstly, these mechanisms will be explained based on the electrostatic acceleration mode. FIG. 5 is a conceptual explanatory diagram of the electrostatic acceleration model-based acceleration mechanism of the two-stage Hall-effect plasma accelerator 200. In FIG. 5, the acceleration channel 202 is illustrated in a partially cutaway perspective sectional view, and each of a magnetic field B, an electric field E, a propellant neutral particle (indicated by "n"), an electron (indicated by "e") and a propellant ion (indicated by "p") is illustrated in a model format.

The ion acceleration mechanism based on the electrostatic acceleration model is as follows. Within the acceleration channel 202, an electric field E is formed that is a DC electric field generated by an acceleration voltage applied axially from the upstream end to the downstream end. A magnetic field B formed in the radial direction of the acceleration channel 202 has an intensity distribution suitable for the ion acceleration. Differently from the conventional Hall-effect plasma accelerator 100, it is unnecessary for the intensity distribution to be designed to have a lower value in the upstream region in consideration of the plasma generation. A intensity of the magnetic field B and its region to be formed in the space of the acceleration channel are appropriately set in such a manner as to rotate an electron around the magnetic field line to restrain the electron by the magnetic field B, and allow a propellant ion to be moved approximately linearly without restraint by the magnetic field B.

The acceleration mechanism will be specifically described. A part of electrons emitted from the cathode 207 disposed in the vicinity of downstream open end of the acceleration channel 202 are drawn by the anode 206 to thereby enter into the space of the acceleration channel 202. The electrons entered in the acceleration channel 202 act to reduce a space charge limiting effect in an acceleration section so as to assist the acceleration of propellant ions. The reference code E53 in FIG. 5 indicates one electron restrained by the magnetic field B due to a Larmor motion induced therein. The electron E53 is gradually drawn by the anode 206 to move to the upstream end of the acceleration channel 202.

In the upstream end of the acceleration channel 202, a propellant neutral particle N52 is ionized by a high-frequency wave M51 supplied from the cavity resonator 211 through the high-frequency wave transmitting window portion 212, to generate plasma. The generated plasma includes an electron E52 and a propellant ion P52.

The generated propellant ion P52 has a large enough mass to avoid the restraint on its axial movement due to a Larmor motion to be induced by the magnetic field B. Thus, the propellant ion P52 is accelerated toward the downstream end by the electric field E, and ejected from the open end of the acceleration channel 202 as a high-speed propellant ion P55 to produce a thrust equal to a reaction force against the ejection. The arrow shown above the propellant ion P52 means that the propellant ion P52 starts being accelerated toward the downstream end. Further, the arrow shown above the propellant ion P54 means that the propellant ion P54 accelerated from the upstream region to the intermediate region of the acceleration channel 202 is further accelerated toward the downstream end without restraint by the magnetic field B. In the downstream region of the acceleration channel 202, the electron E53 is restrained by the magnetic field B. Thus, a numbers of electrons can be located in the downstream region of the acceleration channel 202 together with positively-charged propellant ions. That is, the downstream region of the acceleration channel 202 can be kept in an electrically quasi-neutral plasma state. This makes it possible to apply a large voltage between the cathode 207 and the anode 206 so as to supply a large current therebetween without restrictions from the law for space-charge limited current, whereby a larger number of propellant ions can be accelerated and ejected to obtain higher thrust. An electron E55 as a part of electrons emitted from the cathode 207 is moved in the downstream direction of the acceleration channel 202 to neutralize the propellant ion P55. Thus, the electron E55 produces an electron current flow having an intensity equal to that of an ion current produced by the propellant ion P55. All of the electrons in the acceleration channel 202 will be finally absorbed by the anode 206.

Figure 6:
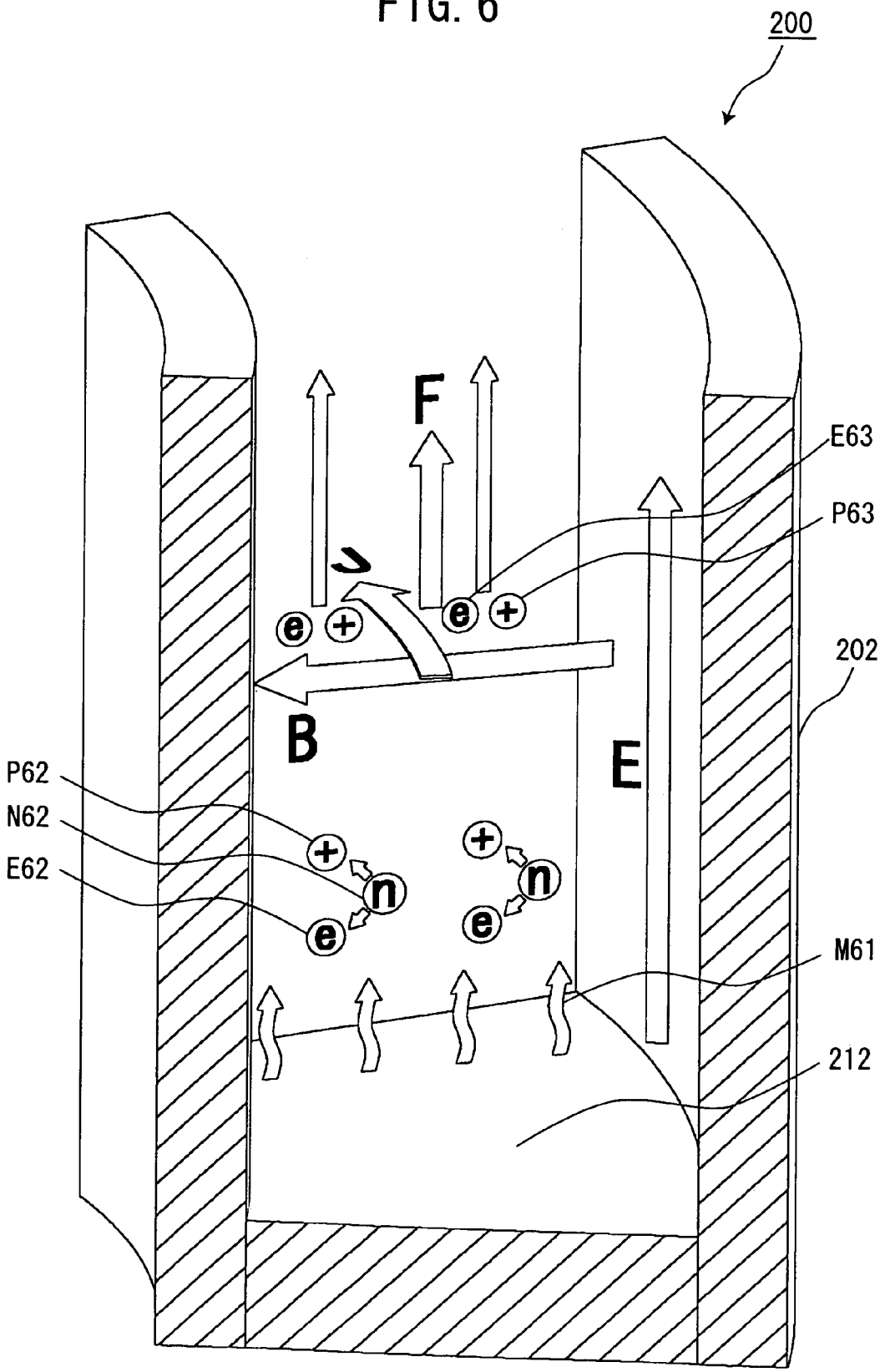
FIG. 6 is a conceptual explanatory diagram of an electromagnetic acceleration model-based acceleration mechanism of the high-frequency discharge plasma generation-based two-stage Hall-effect plasma accelerator 200.

Secondly, the plasma generation and ion acceleration mechanisms will be explained based on the electromagnetic acceleration model. FIG. 6 is a conceptual explanatory diagram of the electromagnetic acceleration model-based acceleration mechanism of the above Hall-effect plasma accelerator 200. In FIG. 6, the acceleration channel 202 is illustrated in a partially cutaway perspective sectional view, and each of a magnetic field B, an electric field E, a current J, a Lorentz force F, an electron (indicated by "e") and a propellant ion (indicated by "p") is illustrated in a model format.

Figure 2:
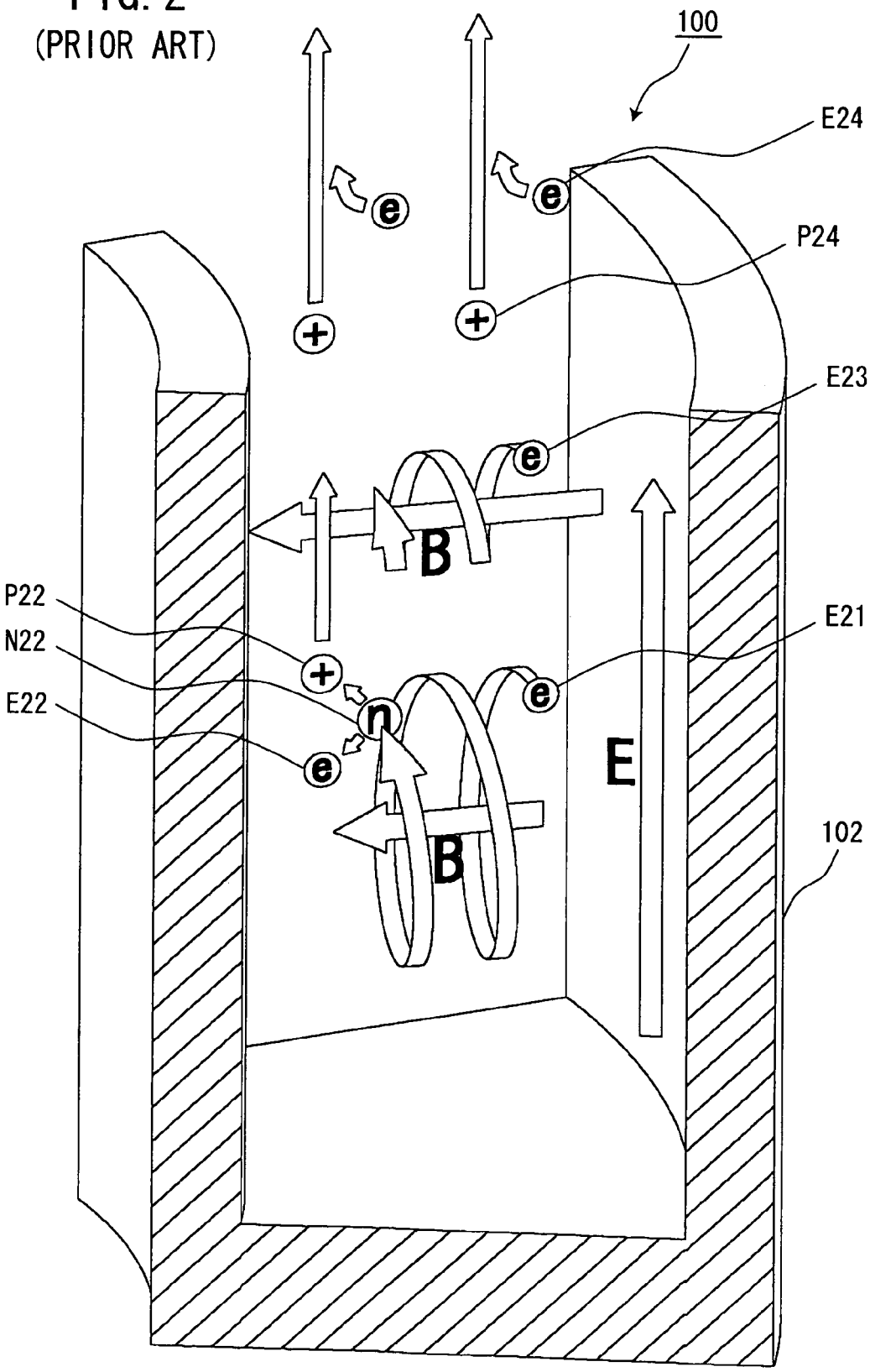
FIG. 2 (PRIOR ART)
FIG. 2 is a conceptual explanatory diagram of an electrostatic acceleration model-based acceleration mechanism of the conventional Hall-effect plasma accelerator 100.
Figure 3:
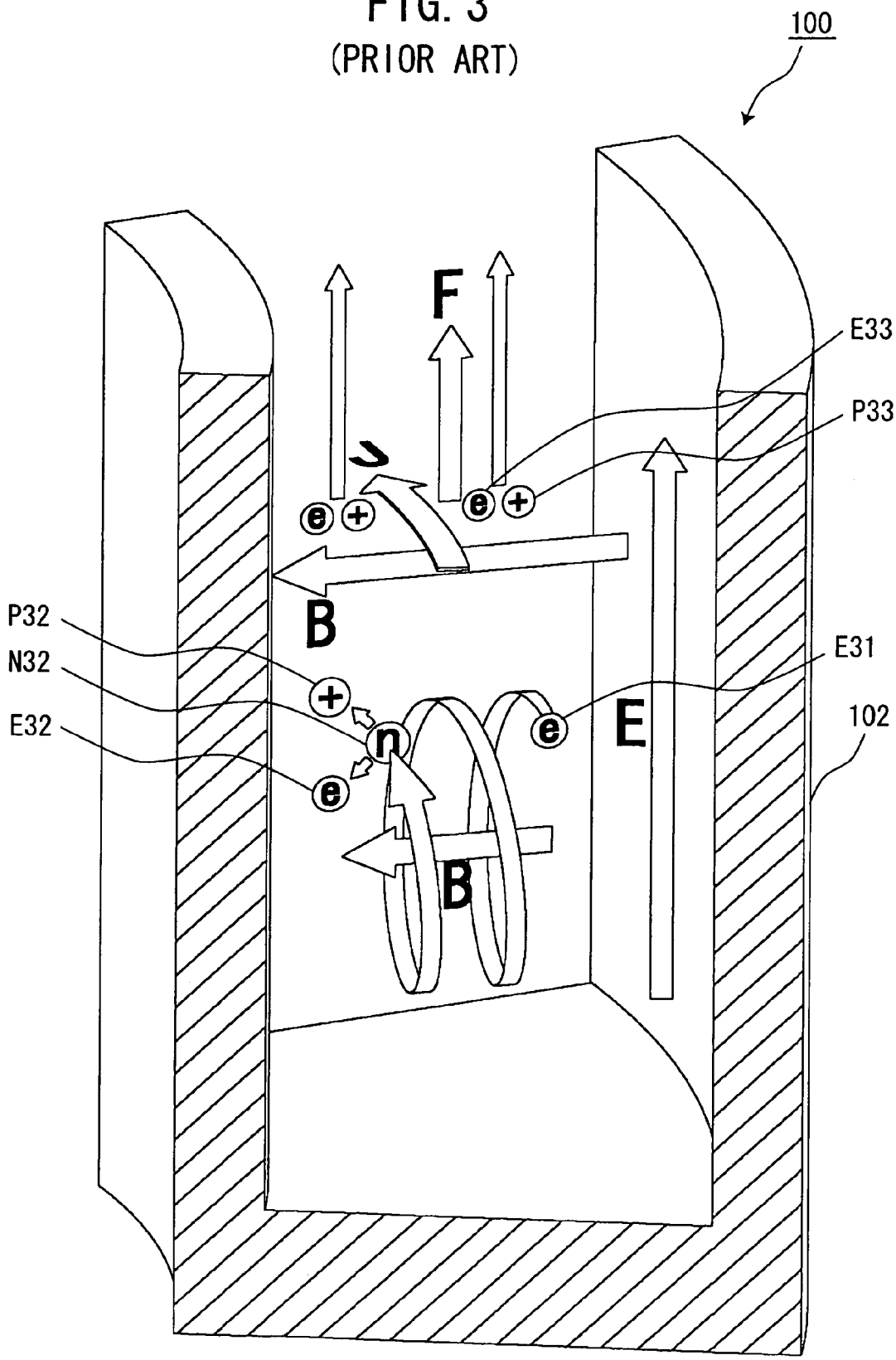
FIG. 3 (PRIOR ART)
FIG. 3 is a conceptual explanatory diagram of an electromagnetic acceleration model-based acceleration mechanism of the conventional Hall-effect plasma accelerator 100.

In FIG. 6, as with the electrostatic acceleration model-based acceleration mechanisms illustrated in FIG. 2, plasma is accelerated from the upstream region to the downstream region of the acceleration channel 202, and ejected from the open end of the acceleration channel 202 to produce a thrust equal to a reaction force against the ejection.

The acceleration mechanism will be more specifically described. An electron E63 and a propellant ion P63 in FIG. 6 constitute plasma. The electron E63 is moved in the circumferential direction due to an E×B drift during a Larmor motion around the magnetic line of the magnetic field B. A current J flows in the opposite direction of the drift direction. The plasma with the current J passing therethrough is subject to a Lorentz force generated by the interaction with the magnetic field B, and moved in the downstream direction. Thus, the plasma including the electron E63 and the propellant ion P63 is accelerated and ejected from the downstream end of the acceleration channel 202 to produce a thrust equal to a reaction force against the ejection. In this electromagnetic acceleration model, plasma is primarily generated in the plasma generation section, as with the aforementioned electrostatic acceleration model-based mechanism. Specifically, in the upstream end of the acceleration channel 202, a propellant neutral particle N62 is ionized by a high-frequency wave M61 supplied from the cavity resonator 211 through the high-frequency wave transmitting window portion 212, to generate plasma. The generated plasma includes an electron E62 and a propellant ion P62.

As above, the acceleration mechanism of the two-stage Hall-effect plasma accelerator 200 has been described based on the electrostatic and electromagnetic acceleration models. In either case, the plasma generation is achieved by the high-frequency wave, the propellant ion acceleration is achieved by the DC electric field axially generated by the acceleration voltage. This makes it possible to control the acceleration voltage and the high-frequency power in an independent manner, respectively, as an acceleration control parameter and a plasma-generation control parameter.

Figure 8:
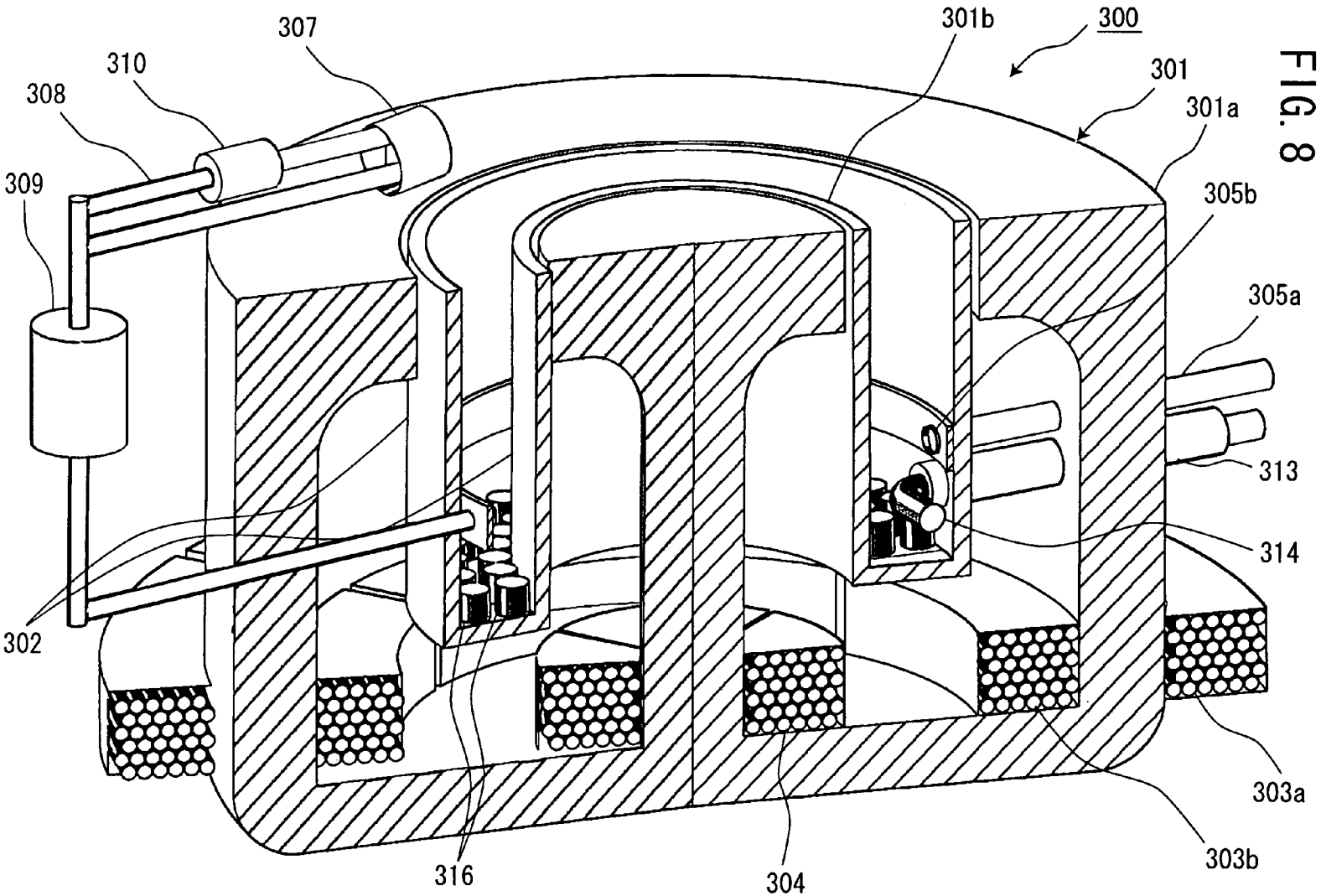
FIG. 8 is a partially cutaway perspective sectional view showing the structure of a high-frequency discharge plasma generation-based two-stage Hall-effect plasma accelerator 300 according to another embodiment of the present invention.

Another embodiment of the present invention will be described below, wherein the generation of plasma from propellant gas is achieved by utilizing electron cyclotron resonance (ECR). This embodiment does not have a component corresponding to the high-frequency wave transmitting window portion 212 in the two-stage Hall-effect plasma accelerator 200. FIG. 8 is a partially cutaway perspective sectional view showing the structure of a high-frequency discharge plasma generation-based two-stage Hall-effect plasma accelerator 300 according to another embodiment of the present invention (hereinafter referred to as "two-stage Hall-effect plasma accelerator 300" for brevity). The two-stage Hall-effect plasma accelerator 300 comprises a pole piece 301, an acceleration channel 302, a coil 303*a*, a coil 303*b*, a coil 304, a propellant feed port 305*a*, a propellant discharge port 305*b*, an anode 306, a cathode 307, a wiring 308, an acceleration power source 309, a neutralizer power source 310, a waveguide 313, a high-frequency wave introduction probe 314, a high-frequency oscillator 315 (While not shown in FIG. 8, it is identical to the high-frequency oscillator 215 in FIG. 7), and resonating magnetic field generation means 316. In the two-stage Hall-effect plasma accelerator 300 illustrated in FIG. 8, each of the elements or components corresponding to those of the two-stage Hall-effect plasma accelerator 200 is defined by a reference numeral derived by adding 100 to the reference numeral of the two-stage Hall-effect plasma accelerator 200.

Each structure of the pole piece 301, the acceleration channel 302, the coil 303*a*, the coil 303*b*, the coil 304, the propellant feed port 305*a*, the propellant discharge port 305*b*, the anode 306, the cathode 307, the wiring 308, the acceleration power source 309, the neutralizer power source 310, the waveguide 313, the high-frequency wave introduction probe 314 and the high-frequency oscillator 315 is the same as that of the corresponding component in the two-stage Hall-effect plasma accelerator 200, except for some arrangement.

Specifically, the anode 306 is placed in an upstream region of the acceleration channel 302 on the opposite side on an outlet of the acceleration channel 302, and the high-frequency wave introduction probe 314 is disposed upstream of the anode 306. Further, the resonating magnetic field generation means 316 is placed on the upstream side of the high-frequency wave introduction probe 314.

The relationship between structural elements in the appended claims and the components of the two-stage Hall-effect plasma accelerator 300 is as follows: the annular acceleration channel corresponds to the acceleration channel 302; the gas inlet port corresponds to the propellant discharge port 305*a*; the anode corresponds to the anode 306; the cathode corresponds to the cathode 307; the neutralizing electron generation portion corresponding to the cathode 307 and the neutralizer power source 310; the magnetic-field generation means corresponds to the pole piece 301 and the coils 303*a*, 303*b*, 304; the high-frequency wave generation means corresponds to the high-frequency oscillator 315; the high-frequency wave introduction means corresponds to the waveguide 313 and the high-frequency introduction probe 314, the acceleration voltage serving as an acceleration control parameter corresponds to a voltage to be generated by the acceleration power source 309, and the high-frequency wave output serving as a plasma-generation control parameter corresponds to a high-frequency wave to be generated by the high-frequency oscillator 315.

The resonating magnetic field generation means 316 comprises two groups of magnets wherein respective groups disposed opposed to one another in such a manner as to allow their magnet poles different in polarity to be located face-to-face. In FIG. 8, a plurality of columnar permanent magnets are arranged to form a double loop. One magnet group on the inner loop and the other magnet group on the outer loop are disposed such that their magnet poles different in polarity are located face-to-face. For example, when the permanent magnet on the inner loop has a top face of S-pole and a bottom face of N-pole, the permanent magnet on the outer loop has a top face of N-pole and a bottom face of S-pole. The resonating magnetic field generation means comprising the permanent magnets arranged in this way can form a mirror magnetic field for confining plasma therein. The mirror magnetic field has a distribution of magnetic flux density with a higher value on each side of the magnet loops and a lower value in the intermediate region between the magnet loops. Thus, this magnetic field configuration makes it possible to reflect plasma toward the central region by the strong flux on both edge sides so as to confine the plasma in the magnetic field. Further, the magnetic flux intensity in a specific position [electron cyclotron resonance (ECR) region] within the mirror field is arranged to cause electron cyclotron resonance at the frequency of a high-frequency wave to be introduced therein. Thus, when an electron of propellant gas passes through the ECR region, it is accelerated by the electron cyclotron resonance, and ionized.

Figure 9:
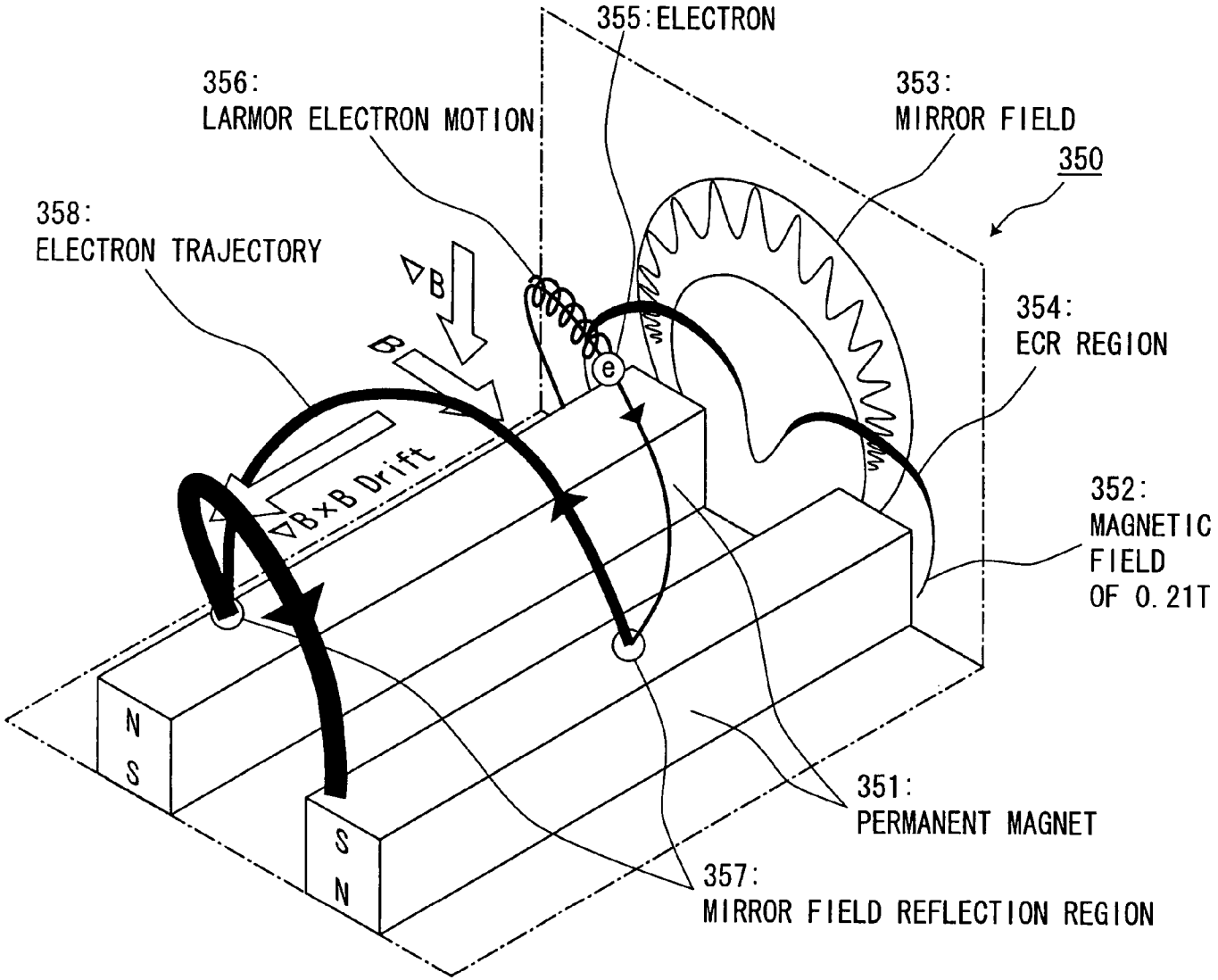
FIG. 9 is a conceptual explanatory diagram of a plasma generation mechanism model 350 based on electron cyclotron resonance (ECR).

A general mechanism of electron cyclotron resonance using a mirror magnetic field will be described below. FIG. 9 is a conceptual explanatory diagram of a plasma generation mechanism model 350 based on electron cyclotron resonance. In the plasma generation mechanism model 350, two groups of permanent magnets 315 are disposed opposed to one another in such a manner as to allow their magnet poles different in polarity to be located face-to-face, so that 0.21 T of magnetic field 352 is generated to form a mirror magnet 353 with a magnetic flux density distribution having a higher value on each side of the magnet groups and a lower value in the intermediate region between the magnet groups. An ECR region 354 suitable for electron cyclotron resonance extends in a direction orthogonal to the magnetic lines of the mirror field 353. While FIG. 9 shows the mirror field 353 and the ECR region 354 only on the illustrated section, they actually extend along the entire length of the permanent magnets 351 in the same manner. In FIG. 9, the magnetic field has an intensity gradient in a direction as indicated by the arrow ∇B (grad B), and a magnetic field direction in a direction as indicated by the arrow B. In this magnetic field, an electron has a ∇B×B drift, and drifts in a direction as indicated by the arrow ∇B×B Drift. An electron 355 is rotated around the magnetic line according to a Larmor electron motion 356, and moved along an electron trajectory due to the ∇B×B drift and the confinement by the mirror field 353. During this movement, the electron is reflected by a mirror field reflection region 357. Then, when the moving electron passes through the ECR region 354, it is further accelerated by the electron cyclotron resonance to facilitate ionization. In this way, the generation of plasma from the propellant gas is promoted. During the electron cyclotron resonance, an electron is captured within the mirror field, and pumped. Subsequently, the electron is repeatedly accelerated every time it passes through an ECR region. That is, the electron is accelerated in the confined state. Thus, as compared to the non-resonance discharge in the two-stage Hall-effect plasma accelerator 200, even under a weak microwave field, a sufficient acceleration can be obtained by taking an adequate time.

Ions included in the plasma are accelerated toward the open end of the acceleration channel 302 according to the same acceleration mechanism as that in the two-stage Hall-effect plasma accelerator 200, and ejected from the open end to produce thrust.

Figure 10:
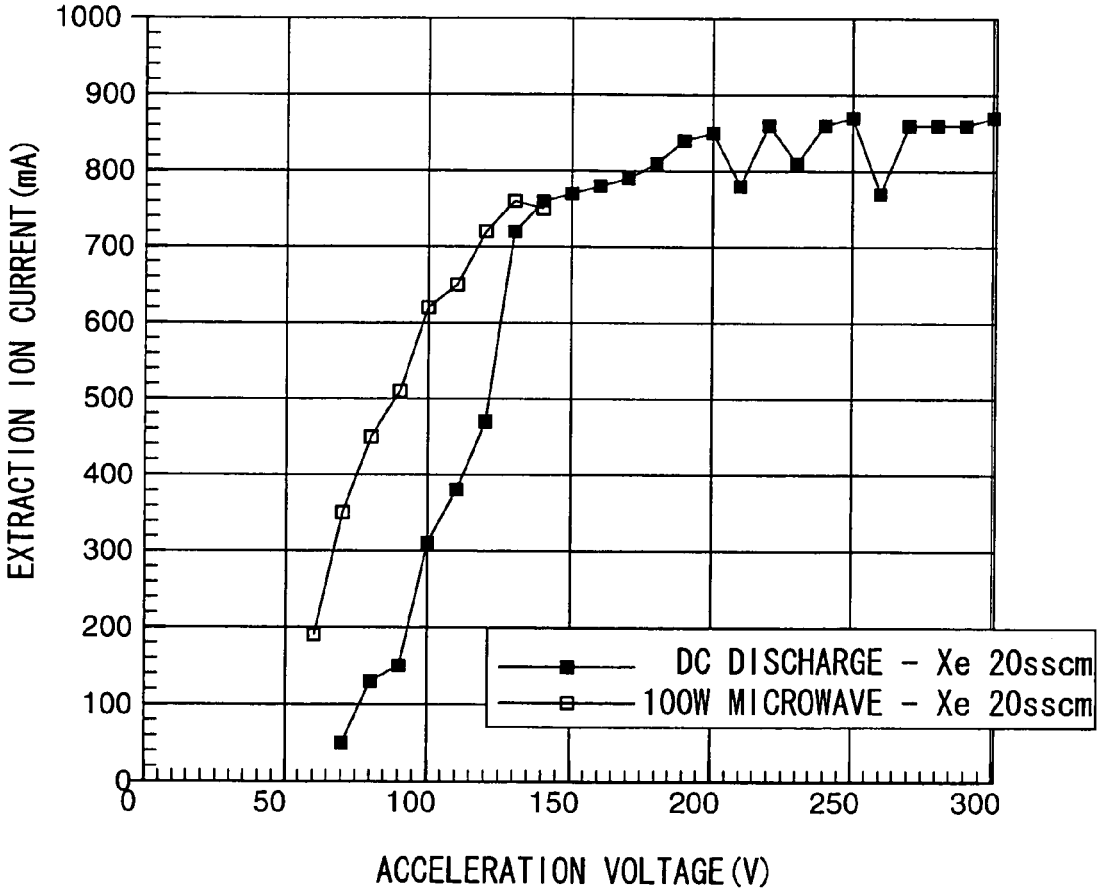
FIG. 10 is a graph showing an acceleration voltage-extraction ion current characteristic in each of a DC discharge plasma generation and a microwave discharge plasma generation.

In order to verify performances of the high-frequency discharge plasma generation-based two-stage Hall-effect plasma accelerator of the present invention, the inventor experimentally prepared an apparatus capable of performing both a single-stage acceleration and a two-stage acceleration, and characteristics of each type was measured. FIG. 10 is a graph showing an acceleration voltage-extraction ion current characteristic in each of a DC discharge plasma generation and a microwave discharge plasma generation. An extraction ion current is proportional to a quantity of ejected ions per unit time. In FIG. 10, the plain square (□) is a plot of the measurement result in a high-frequency discharge plasma generation, and the black square (■) is a plot of the measurement result in a DC discharge plasma generation (based on the conventional single-stage Hall-effect plasma accelerator). As seen in FIG. 10, in a relatively low acceleration voltage range of 60 to 130 V, the high-frequency discharge type provides a larger extraction ion current than that in the DC discharge type. Specifically, in a low voltage (low specific thrust) region, the increase in extraction current is observed. Thus, according to the two-stage Hall-effect plasma accelerators 200 and 300 according to the above embodiments can have a wide operational range extending to a lower acceleration voltage region to achieve enhanced ion ejection characteristics.

Figure 11:
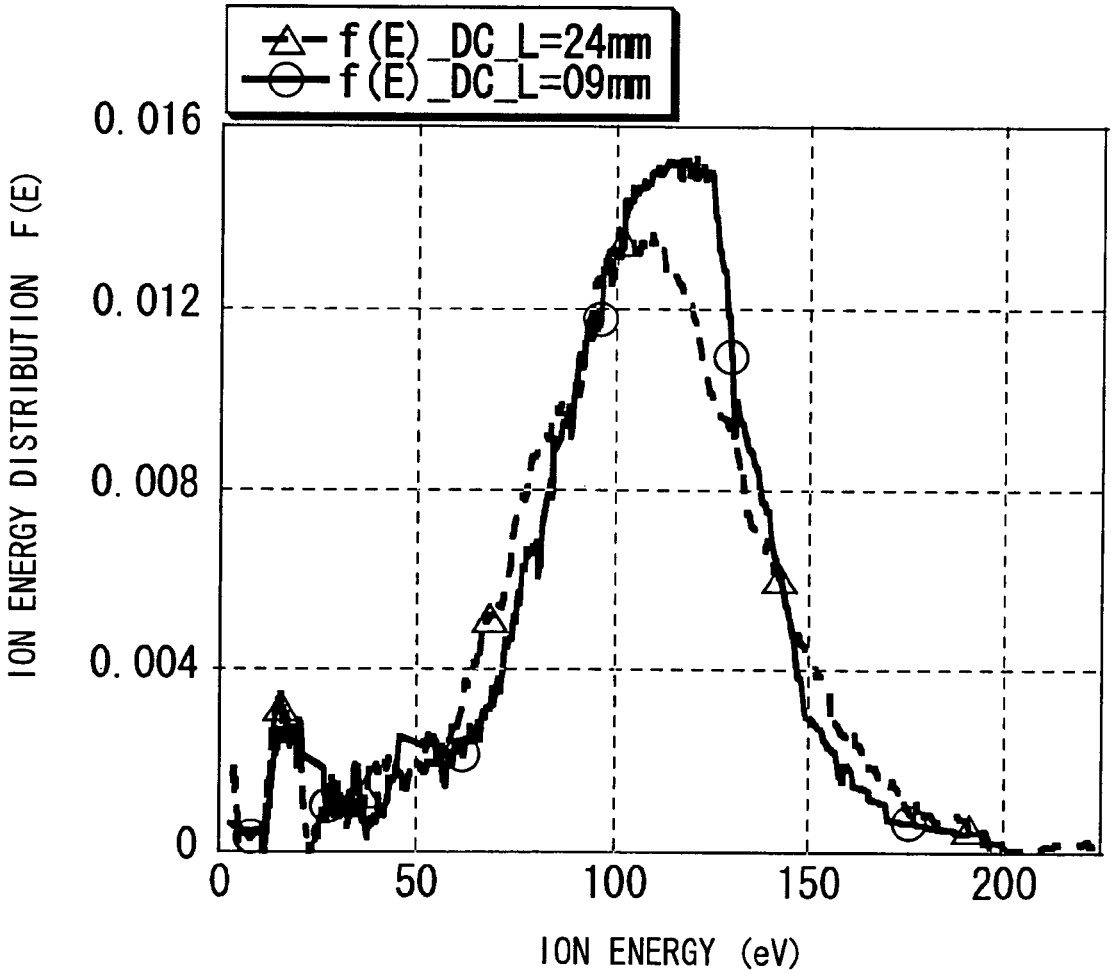
FIG. 11 is a graph showing the measurement result of an ion energy distribution of ejected ions in the DC discharge plasma generation.
Figure 12:
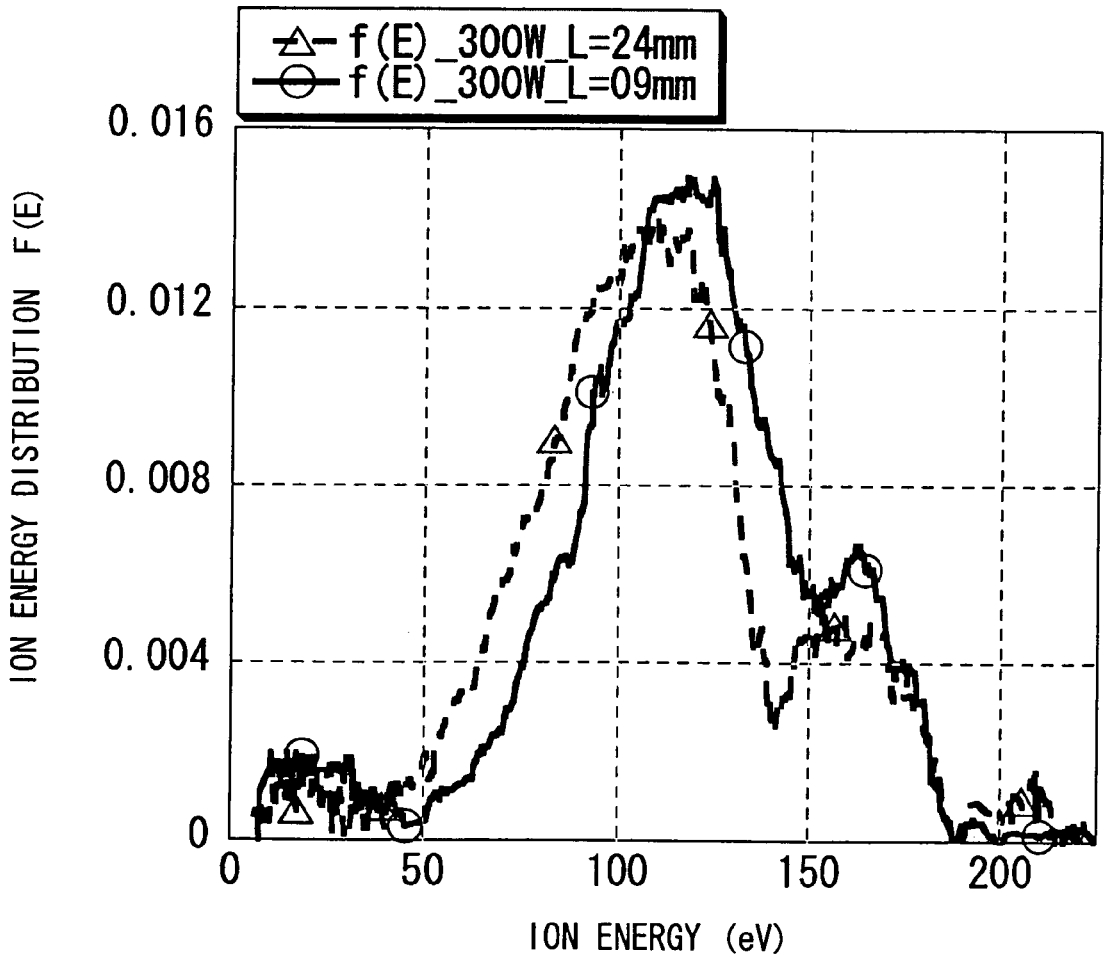
FIG. 12 is a graph showing the measurement result of an ion energy distribution of ejected ions in the microwave discharge plasma generation The reference numerals in the above figures are explained as follows.

The two-stage Hall-effect plasma accelerators 200 and 300 according to the above embodiments can generate plasma in a different manner from the conventional mechanism to efficiently generate plasma. FIG. 11 is a graph showing the measurement result of an ion energy distribution of ejected ions in the DC discharge plasma generation. FIG. 12 is a graph showing the measurement result of an ion energy distribution of ejected ions in the microwave discharge plasma generation. In FIGS. 11 and 12, a plot indicated by the triangle (Δ) is a measurement result under the condition of L (length of the acceleration channel)=24 mm, and a plot indicated by the circle (○) is a measurement result under the condition of L=9 mm. As seen in FIG. 11, depending on L, the conventional DC discharge plasma generation produces plasma which has ion energy exhibiting a peak at 100 to 120 eV. In contract, referring to FIG. 12, the high-frequency discharge plasma generation can produces plasma which has ion energy exhibiting peaks at 110 to 120 eV and around 160 eV. This shows that the two-stage Hall-effect plasma accelerators 200, 300 according to the above embodiments can newly produce additional plasma based on the high-frequency discharge to effectively generate plasma.

The two-stage Hall-effect plasma accelerator of the present invention may be used for an ion acceleration apparatus (for use on the ground) using an ion source as the plasma-generating gas, and a plasma etching apparatus using an ion source for spattering, as the plasma-generating gas, as well as a space propulsion engine. In addition, the two-stage Hall-effect plasma accelerator of the present invention may be used for an ion acceleration apparatus and a plasma etching apparatus which comprise an anode and a beam target for emitting ions without the neutralizer or neutralizer power source, wherein an acceleration voltage is applied between the beam target and the anode to allow the beam target to serve as a cathode.

As mentioned above, the two-stage Hall-effect plasma accelerator of the present invention can variably control the energy distribution to each the plasma generation and the ion acceleration to efficiently activate each function in a desired operational range so as to achieve enhanced propulsion efficiency. The two-stage Hall-effect plasma accelerator of the present invention can also variably control specific thrust and thrust in a wide range to achieve reduction in power consumption over a wide operational range. According to the two-stage Hall-effect plasma accelerator of the present invention, the need for accurate magnetic-field design can be eliminated to ease the requirements on components, weight, power, etc., for an accurate magnetic-field configuration. Thus, flexibility in magnetic-field design is increased to allow the parallelization in ejected ion beams to be improved at high levels. Further, the restrictions on the upper limit of operating temperature of a magnetic material can be relaxed. The two-stage Hall-effect plasma accelerator of the present invention can control the position of the plasma generation to be located adjacent to the ion acceleration region without depending on a magnetic field configuration. In addition, the need for reverse-flow current which has been essential to plasma generation can be eliminated to achieve enhanced total efficient. The two-stage Hall-effect plasma accelerator of the present invention is designed to perform the plasma generation and the ion acceleration using individual power sources. This makes it possible to prevent the ratio between the plasma generation and the ion acceleration from changing in a vibrating manner. Thus, no discharge plasma fluctuation phenomenon occurs in principle. Further, the number of types of usable working medium for space can be increased.

The present invention has been described with reference to specific embodiments for purposes of illustration, but is not intended to be limited to the specific embodiments. It is obvious to those skilled in the art that various changes and modifications may be made therein without departing from the spirit and scope thereof as set forth in appended claims.

What is claimed is:

1. A high-frequency discharge plasma generation-based two-stage Hall-effect plasma accelerator comprising an ion acceleration section, and a high-frequency wave supply section for supplying a high-frequency wave to said ion acceleration section, said ion acceleration section including:

an annular acceleration channel comprising two concentric cylindrical structures different in radius and a space defined between said concentric cylindrical structures, said concentric cylindrical structures having a first end formed as an open end for ejecting an ion therefrom and a second, opposite, end located adjacent to said high-frequency wave supply section;

a gas inlet port connected to said annular acceleration channel at a position adjacent to said high-frequency wave supply section to introduce a plasma-generating gas from the outside to the inside of said annular acceleration channel;

an anode disposed in the space of said annular acceleration channel at a position adjacent to said high-frequency wave supply section;

a cathode disposed in the vicinity of said first open end of said annular acceleration channel and adapted to have an acceleration voltage to be applied at a given level with respect to said anode;

a neutralizing electron generation portion adapted to generate an electron for neutralizing the ion ejected from said annular acceleration channel;

magnetic-field generation means for generating a magnetic field having a given intensity distribution in the radial direction from the central axis of said annular acceleration channel; and high-frequency wave generation means for generating a high-frequency wave to be introduced in the space of said annular acceleration channel, whereby: said plasma-generating gas introduced from said gas inlet port into the space of said annular acceleration channel is ionized by the high-frequency wave supplied from said high-frequency wave supply section to generate plasma;

a positive ion included in said generated plasma is accelerated in the space of said annular acceleration channel toward said first open end by said acceleration voltage applied between said anode and said cathode, and ejected outside; and an electron included in said generated plasma is restricted in its movement in the axial direction of said concentric cylindrical structures by an interaction with said radial magnetic field, said high-frequency wave supply section including high-frequency wave introduction means for introducing the high-frequency wave generated by said high-frequency wave generation means, into the space of said annular acceleration channel, wherein: said ion acceleration section is operable to control a degree of said ion acceleration in accordance with said acceleration voltage serving as an acceleration control parameter; and said high-frequency wave supply section is operable to control an amount of said plasma generation in accordance with said high-frequency wave output serving as a plasma-generation control parameter to be controlled independently of said acceleration control parameter.

2. The two-stage Hall-effect plasma accelerator as defined in claim 1, wherein said high-frequency wave supply section further includes a cavity portion disposed adjacent to said second end of said concentric cylindrical structures, and formed with a cavity adapted to allow a high-frequency wave to be introduced therein, wherein said high-frequency wave introduction means is operable to introduce a high-frequency wave into the cavity of said cavity portion to thereby introduce said high-frequency wave into the space of said annular acceleration channel.

3. The two-stage Hall-effect plasma accelerator as defined in claim 2, wherein said cavity portion serves as a cavity resonator for inducing resonance in the high-frequency wave introduced in said cavity.

4. The two-stage Hall-effect plasma accelerator as defined in claim 3, wherein said high-frequency wave supply section further includes a high-frequency-wave transmitting window portion disposed between said cavity portion and said second end of said concentric cylindrical structures, said high-frequency-wave transmitting window portion being made of a material capable of transmitting a high-frequency wave therethrough, and adapted to prevent said plasma-generating gas from permeating therethrough.

5. The two-stage Hall-effect plasma accelerator as defined in claim 1, which further includes resonating magnetic field generation means disposed on the opposite side of said second open end of said annular acceleration channel with respect to said high-frequency wave introduction means, and adapted to induce electron cyclotron resonance when a high-frequency wave having an electron cyclotron resonance frequency is introduced therein, whereby the high-frequency wave introduced into the space of said annular acceleration channel by said high-frequency wave introduction means ionizes said plasma-generating gas at a position corresponding to the magnetic field formed by resonating magnetic field generation means, in accordance with the electron cyclotron resonance.

6. The two-stage Hall-effect plasma accelerator as defined in claim 5, wherein said resonating magnetic field generation means is operable to form a mirror field for confining plasma therewithin.

7. The two-stage Hall-effect plasma accelerator as defined in claim 1, which is designed to allow inactive plasma to be led to the vicinity of said anode.

8. A space propulsion engine comprising the two-stage Hall-effect plasma accelerator as defined in claim 1, wherein said plasma-generating gas is a propellant.

9. An ion acceleration apparatus comprising the two-stage Hall-effect plasma accelerator as defined in claim 1, wherein said plasma-generating gas is an ion source.

10. A plasma etching apparatus comprising the two-stage Hall-effect plasma accelerator as defined in claim 1, wherein said plasma-generating gas is an ion source for sputtering.

11. An ion acceleration apparatus for use on the ground, comprising a high-frequency discharge plasma generation-based two-stage Hall-effect plasma accelerator, and a beam target, said two-stage Hall-effect plasma accelerator having an ion acceleration section, and a high-frequency wave supply section for supplying a high-frequency wave to said ion acceleration section, said ion acceleration section including:

an annular acceleration channel comprising two concentric cylindrical structures different in radius and a space defined between said concentric cylindrical structures, said concentric cylindrical structures having a first end formed as an open end for ejecting an ion therefrom and a second, opposite, end located adjacent to said high-frequency wave supply section;

a gas inlet port connected to said annular acceleration channel at a position adjacent to said high-frequency wave supply section to introduce a plasma-generating gas serving as an ion source, from the outside to the inside of said annular acceleration channel;

an anode disposed in the space of said annular acceleration channel at a position adjacent to said high-frequency wave supply section;

magnetic-field generation means for generating a magnetic field having a given intensity distribution in the radial direction from the central axis of said annular acceleration channel; and high-frequency wave generation means for generating a high-frequency wave to be introduced in the space of said annular acceleration channel, said beam target being disposed in the vicinity of said first open end of said annular acceleration channel and adapted to have an acceleration voltage to be applied at a given level with respect to said anode, whereby: said plasma-generating gas introduced from said gas inlet port into the space of said annular acceleration channel is ionized by the high-frequency wave supplied from said high-frequency wave supply section to generate plasma;

a positive ion included in said generated plasma is accelerated in the space of said annular acceleration channel toward said first open end by said acceleration voltage applied between said anode and said beam target, and ejected toward said beam target; and an electron included in said generated plasma is restricted in its movement in the axial direction of said concentric cylindrical structures by an interaction with said radial magnetic field, wherein said high-frequency wave supply section including high-frequency wave introduction means for introducing the high-frequency wave generated by said high-frequency wave generation means, into the space of said annular acceleration channel, wherein: said ion acceleration section is operable to control a degree of said ion acceleration in accordance with said acceleration voltage serving as an acceleration control parameter; and said high-frequency wave supply section is operable to control an amount of said plasma generation in accordance with said high-frequency wave output serving as a plasma-generation control parameter to be controlled independently of said acceleration control parameter.

12. A plasma etching apparatus comprising a high-frequency discharge plasma generation- based two-stage Hall-effect plasma accelerator, and a beam target, said two-stage Hall-effect plasma accelerator having an ion acceleration section, and a high-frequency wave supply section for supplying a high-frequency wave to said ion acceleration section, said ion acceleration section including:

an annular acceleration channel comprising two concentric cylindrical structures different in radius and a space defined between said concentric cylindrical structures, said concentric cylindrical structures having a first end formed as an open end for ejecting an ion therefrom and a second, opposite, end located adjacent to said high-frequency wave supply section;

a gas inlet port connected to said annular acceleration channel at a position adjacent to said high-frequency wave supply section to introduce a plasma-generating gas serving as an ion source for sputtering, from the outside to the inside of said annular acceleration channel;

an anode disposed in the space of said annular acceleration channel at a position adjacent to said high-frequency wave supply section;

magnetic-field generation means for generating a magnetic field having a given intensity distribution in the radial direction from the central axis of said annular acceleration channel; and high-frequency wave generation means for generating a high-frequency wave to be introduced in the space of said annular acceleration channel, said beam target being disposed in the vicinity of said first open end of said annular acceleration channel and adapted to have an acceleration voltage to be applied at a given level with respect to said anode, whereby: said plasma-generating gas introduced from said gas inlet port into the space of said annular acceleration channel is ionized by the high-frequency wave supplied from said high-frequency wave supply section to generate plasma;

a positive ion included in said generated plasma is accelerated in the space of said annular acceleration channel toward said first open end by said acceleration voltage applied between said anode and said beam target, and ejected toward said beam target; and an electron included in said generated plasma is restricted in its movement in the axial direction of said concentric cylindrical structures by an interaction with said radial magnetic field, wherein said high-frequency wave supply section including high-frequency wave introduction means for introducing the high-frequency wave generated by said high-frequency wave generation means, into the space of said annular acceleration channel, wherein: said ion acceleration section is operable to control a degree of said ion acceleration in accordance with said acceleration voltage serving as an acceleration control parameter; and said high-frequency wave supply section is operable to control an amount of said plasma generation in accordance with said high-frequency wave output serving as a plasma-generation control parameter to be controlled independently of said acceleration control parameter.

* * * * *